US005350650A

United States Patent [19]

Gasper et al.

[11] Patent Number: 5,350,650

[45] Date of Patent: Sep. 27, 1994

[54] METHODS FOR THE RETRIEVAL OF BLUE, GREEN AND RED EXPOSURE RECORDS OF THE SAME HUE FROM A PHOTOGRAPHIC ELEMENTS CONTAINING EMISSIVE INTERLAYERS

[75] Inventors: John Gasper, Hilton, N.Y.; Gareth B. Evans, Potten End, England; Christopher B. Rider, Mitcham Surrey, England; Michael J. Simons, Ruislip, England

[73] Assignee: Eastman Kodak Company, Rochester, N.Y.

[21] Appl. No.: 93,507

[22] Filed: Jul. 16, 1993

[30] Foreign Application Priority Data

Feb. 12, 1993 [GB] United Kingdom ..... 93002819

[51] Int. Cl.[5] ..... G03C 11/00; G03C 5/16; G03C 7/00; G03C 5/22

[52] U.S. Cl. ..... 430/21; 430/139; 430/356; 430/363; 430/364; 430/367; 430/502; 430/507

[58] Field of Search ..... 430/21, 139, 356, 363, 430/364, 367, 369, 502, 507; 250/486.1; 356/318

[56] References Cited

U.S. PATENT DOCUMENTS

| | | | |
|---|---|---|---|
| 4,065,310 | 12/1977 | Dujardin et al. | 430/21 |
| 4,425,426 | 1/1984 | Abbott et al. | 430/502 |
| 4,543,308 | 9/1985 | Schumann et al. | 430/21 |
| 4,619,892 | 10/1986 | Simpson et al. | 430/507 |
| 4,777,102 | 10/1988 | Levine | 430/21 |
| 4,788,131 | 11/1988 | Kellogg et al. | 430/394 |

FOREIGN PATENT DOCUMENTS

| | | | |
|---|---|---|---|
| 2514137 | 9/1976 | Fed. Rep. of Germany | 430/139 |
| 1336397 | 8/1962 | France | 430/139 |
| 760775 | 11/1956 | United Kingdom . | |

OTHER PUBLICATIONS

Belgian Report 95B, p. 18, No. 618224, May 1962.

*Research Disclosure*, vol. 308, Dec. 1989, Item 308119, pp. 993–1015.

*Research Disclosure, vol. 134, Jun. 1975, Item 13452, pp. 47–48.*

*Research Disclosure*, vol. 253, May 1985, Item 25330, pp. 237–240.

*Primary Examiner*—Charles L. Bowers, Jr.

*Assistant Examiner*—J. Pasterczyk

*Attorney, Agent, or Firm*—Carl O. Thomas

[57] ABSTRACT

A method is disclosed of obtaining from an imagewise exposed photographic element separate records of the imagewise exposure to each of the blue, green and red portions of the spectrum comprising photographically processing an imagewise exposed photographic element comprised of a sequence of superimposed blue, green and red recording silver halide emulsion layer units that produce images of the same hue upon processing (e.g., units lacking a dye-forming coupler). A first interlayer unit overlies the emulsion layer unit nearest the support and is capable of transmitting to it imagewise exposing radiation this emulsion layer unit is intended to record. A second interlayer unit underlies the emulsion layer unit farthest from the support and is capable of transmitting to the emulsion layer units lying nearer the support imagewise exposing radiation these emulsion layer units are intended to record. The imagewise exposed photographic element is photographically processed to produce a silver image in each of the emulsion layer units. After photographic processing one of the interlayer units is capable of absorbing electromagnetic radiation within at least one wavelength region and emitting within a longer wavelength region, and the remaining of the first and second interlayer units is capable of reflecting or absorbing electromagnetic radiation within at least one wavelength region. The photographic element is scanned utilizing emission from one of the interlayer units to provide a first record of the image information in one of the first and last emulsion layer units and is scanned utilizing reflection or absorption of the remaining interlayer unit to provide a second record of the image information in one other of the emulsion layer units. Additionally, the photographic element is scanned through the first and second interlayer units and all of the emulsion layer units to provide a spectrally undifferentiated third record of the combined images in all of the emulsion layer units. The first, second and third records are compared to obtain separate blue, green and red exposure records.

15 Claims, 1 Drawing Sheet

METHODS FOR THE RETRIEVAL OF BLUE, GREEN AND RED EXPOSURE RECORDS OF THE SAME HUE FROM A PHOTOGRAPHIC ELEMENTS CONTAINING EMISSIVE INTERLAYERS

FIELD OF THE INVENTION

The invention is directed to a method of extracting blue, green and red exposure records from an imagewise exposed silver halide photographic element and to a photographic element particularly adapted for use in the method.

BACKGROUND

In classical black-and-white photography a photographic element containing a silver halide emulsion layer coated on a transparent film support is imagewise exposed to light, producing a latent image within the emulsion layer. The film is then photographically processed to transform the latent image into a silver image that is a negative image of the subject photographed. Photographic processing involves developing (reducing silver halide grains containing latent image sites to silver), stopping development, and fixing (dissolving undeveloped silver halide grains). The resulting processed photographic element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In classical color photography in its most widely used form the photographic film contains three superimposed silver halide emulsion layer units each containing a different subtractive primary dye or dye precursor, one for recording blue light (i.e., blue) exposure and forming a yellow dye image, one for recording green exposure and forming a magenta dye image, and one for recording red exposure and forming a cyan dye image. During photographic processing developing agent is oxidized in the course of reducing latent image containing silver halide grains to silver, and the oxidized developing agent is employed to form the dye image, usually by reacting (coupling) with a dye precursor (a dye-forming coupler). Undeveloped silver halide is removed by fixing and the unwanted developed silver image is removed by bleaching during photographic processing. This approach is most commonly used to produce negative dye images (i.e., blue, green and red subject features appear yellow, magenta and cyan, respectively). Exposure of color paper through the color negative followed by photographic processing produces a positive color print.

Although widely used this form of classical color photography has evolved highly complicated complementary film and paper constructions. For example, a typical color negative film contains not only a minimum of three different emulsion layer units, but also dye-forming couplers, coupler solvents to facilitate their dispersion, masking couplers to minimize image hue distortions in printing onto color paper, and oxidized developing agent scavengers to avoid formation of unwanted dyes. Not only is the film structure complex, but the optical qualities of the film are degraded by the large quantities of ingredients related to dye image formation and management.

A much simpler film that has enjoyed commercial success in classical color photography is a color reversal film that contains three separate emulsion layer units for separately recording blue, green and red exposures, but contains no dye image forming ingredients. The film is initially processed like a black-and-white photographic film to produce three separate silver images in the blue, green and red recording emulsion layer units. The simplicity of construction has resulted in imaging properties superior to those of incorporated dye-forming coupler color negative films.

The factor that has limited use of these color reversal films is the cumbersome technique required for translating the blue, green and red exposure records into viewable yellow, magenta and cyan dye images. Three separate color developments are required to sequentially form dye images in the blue, green and red recording emulsion layer units. This is accomplished in each instance by rendering the silver halide remaining after black-and-white development developable in one layer and then employing a color developer containing a soluble dye-forming coupler to develop and form a dye image in one of the emulsion layer units. Developed silver is removed by bleaching to leave three reversal dye images in the photographic film.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a near infrared beam, relying on developed silver to modulate the beam. Another approach is to address areally the black-and-white negative relying on modulated transmission to a CCD array for image information recording. In color photography blue, green and red scanning beams are modulated by the yellow, magenta and cyan image dyes. In a variant color scanning approach the blue, green and red scanning beams are combined into a single white scanning beam modulated by the image dyes that is read through red, green and blue filters to create three separate records. The records produced by image dye modulation can then be read into any convenient memory medium (e.g., an optical disk). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print at will. Alternatively, the image can be viewed as a video display or printed by a variety of techniques beyond the bounds of classical photography—e.g., xerography, ink jet printing, dye diffusion printing, etc.

A number of other film constructions have been suggested particularly adapted for producing photographic images intended to be extracted by scanning:

Kellogg et al U.S. Pat. No. 4,788,131 extracts image information from an imagewise exposed photographic element by emission from latent image sites of photographic elements held at extremely low temperatures. The required low temperatures are, of course, a deterrent to adopting this approach.

Levine U.S. Pat. No. 4,777,102 relies on the differential between accumulated incident and transmitted light during scanning to measure the light unsaturation remaining in silver halide grains after exposure. This approach is unattractive, since the difference in light unsaturation between a silver halide grain that has not been exposed and one that contains a latent image may be as low as four photons and variations in grain saturation can vary over a very large range.

Schumann et al U.S. Pat. No. 4,543,308 discloses, for electronic image recording in one or more colors, a photographic recording material comprising in at least one silver halide emulsion layer a compound capable of luminescence. The element is imagewise exposed and photographically processed to produce a latent luminescence image. The image information contained in the latent luminescence image is scanned and recorded electronically. In multicolor imaging it is contemplated to form separate latent luminescence images to represent each color record. The disadvantage of this approach is that luminescence images must be formed. When spectral sensitizing dyes are employed for this purpose, a preferred embodiment, the luminescence intensities that the spectral sensitizing dyes can generate is limited, since increasing spectral sensitizing dye concentrations beyond optimum levels is well recognized to desensitize silver halide emulsions.

Light reflection during imagewise exposure is a recognized phenomenon that is usually unwanted. When exposing light passes through an emulsion layer unit of a silver halide photographic element and is then reflected back so that it passes through the emulsion layer unit twice, the result is an unsharp image and the effect is referred to as halation, since a bright object will often appear to be surrounded by a halo. The common approach to reducing unwanted reflection is to incorporate in a photographic element an antihalation layer that absorbs exposing light after it has passed through the emulsion layer unit or units to prevent reflection. Antihalation layers are removed or decolorized during processing and therefore have no role in viewing the image. Typical antihalation materials are set out in Research Disclosure, Vol. 308, December 1989, Item 308119, Section VIII, paragraph C, and their discharge (decolorization or solubilization) is addressed in paragraph D. Research Disclosure is published by Kenneth Mason Publications, Ltd., Dudley House, 12 North St., Emsworth, Hampshire P010 7DQ, England.

While exposure reflection is undesirable in reducing image sharpness, it has been used to advantage to increase speed. Yutzy and Carroll U.K. Patent 760,775 disclose using titania or zinc oxide in an undercoat beneath a silver halide emulsion layer unit to reflect from 40 to 90 percent of the light received. Research Disclosure, Vol. 134, June 1975, Item 13452, discloses increasing photographic sensitivity by incorporating within or directly beneath an emulsion layer small reflective particles that scatter light. In FIG. 1 a relationship between particle size and light scattering is provided. Buhr et al Research Disclosure, Vol. 253, May 1985, Item 25330, discusses the transmission and reflection relationship between the thickness of tabular silver halide grains and the wavelength of light used for exposure.

SUMMARY OF THE INVENTION

This invention has as its purpose to provide a method of extracting from a silver halide color photographic element independent image records representing imagewise exposures to the blue, green and red portions of the visible spectrum without forming dye images. More particularly, the invention is concerned with achieving this objective using color photographic film and photographic processing that are simplified as compared to that required for classical color photography.

The present invention eliminates any need for dye image forming features in the photographic element construction. Further, the processing of the photographic elements is comparable to the simplicity of classical black-and-white photographic processing. Equally as important is that the simplifications can be realized by remaining within the bounds of proven film construction, processing and scanning capabilities.

In one aspect the invention is directed to a method of obtaining from an imagewise exposed photographic element separate records of the imagewise exposure to each of the blue, green and red portions of the spectrum comprising (a) photographically processing an imagewise exposed photographic element comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support and an intermediate emulsion layer unit located between the first and last emulsion layer units, and (b) obtaining separate blue, green and red exposure records from the photographic element, wherein (c) the photographic element is additionally comprised of, interposed between the first emulsion layer unit and the intermediate emulsion layer unit, a first interlayer unit for transmitting to the first emulsion layer unit electromagnetic radiation this emulsion layer unit is intended to record and, interposed between the last emulsion layer unit and the intermediate emulsion layer unit, a second interlayer unit for transmitting to the intermediate and first emulsion layer units electromagnetic radiation these emulsion layer units are intended to record, one of the first and second interlayer units being capable of absorbing electromagnetic radiation within at least one wavelength region and emitting electromagnetic radiation within a longer wavelength region and the remaining of the first and second interlayer units being capable of reflecting or absorbing electromagnetic radiation within at least one wavelength region, (d) the imagewise exposed photographic element is photographically processed to produce a silver image in each of the emulsion layer units, (e) the photographic element is scanned utilizing electromagnetic radiation emitted from one of the first and second interlayer units to provide a first record of the image information in one of the first and last emulsion layer units and is scanned utilizing reflection or absorption of the remaining of the first and second interlayer units to provide a second record of the image information in one other of the emulsion layer units, (f) the photographic element is scanned through the first and second interlayer units and all of the emulsion layer units to provide a third record representing a combination of images in all of the emulsion layer units, and (g) separate blue, green and red exposure records are obtained from the first, second and third records.

In another aspect this invention is directed to a silver halide photographic element capable of being scanned for image information following imagewise exposure and photographic development and fixing comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support, and an intermediate emulsion layer unit located between the first and last emulsion layer units, and a first interlayer unit coated between the first emulsion layer unit and the intermediate emulsion layer unit capable of transmitting to the first emulsion layer unit electromagnetic radiation this emulsion layer unit is intended to record and a second interlayer unit coated between the intermediate emulsion layer unit and the last emulsion layer unit capable of transmitting to the first and intermediate emulsion layer units electromagnetic radiation these emulsion layer units are intended to record, wherein following photographic development and fixing at least one of the interlayer units is absorptive in a scanning wavelength region and emits electromagnetic radiation within a longer wavelength region and the remaining interlayer unit is reflective or absorbing in a scanning wavelength region.

DESCRIPTION OF PREFERRED EMBODIMENTS

Figure 1:
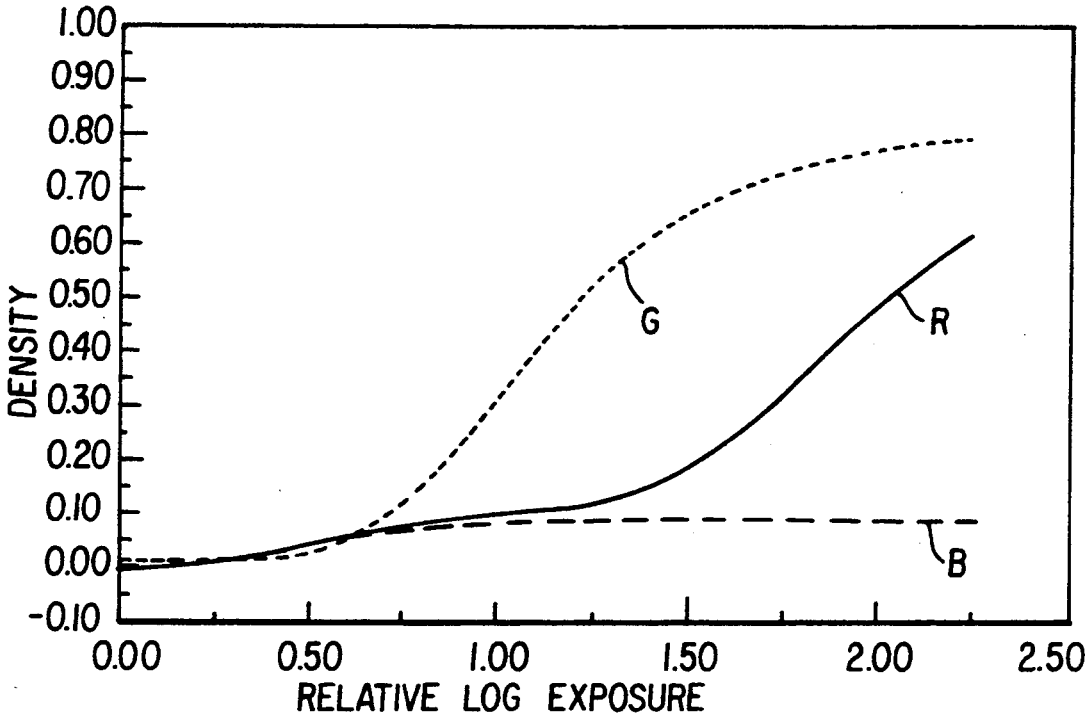
FIGS. 1 and 2 are plots of calculated optical density versus relative log exposure as described in Examples 1 and 2, respectively.

The invention is directed to a photographic element particularly constructed to permit blue, green and red exposure records to be extracted by scanning and to a method of obtaining from the photographic element after imagewise exposure the blue, green and red exposure records. The photographic element is developed to produce silver images corresponding to blue, green and red exposures and fixed to remove silver halide grains in the exposure recording emulsion layer units that are not reduced to silver. Extraction and differentiation of the blue, green and red exposure image information is made possible by employing specifically constructed interlayer units between the emulsion layer units, obtaining one channel of information by a scan that penetrates all of the emulsion layer units and interlayer units (hereafter referred to as an overall scan) and utilizing the interlayer units to obtain two channels of information, where each channel of information is obtained by directing a scanning beam toward and receiving signal information from the same side of the photographic element (hereafter referred to as retroscanning).

During one of the retroscanning steps absorption of electromagnetic radiation in one wavelength region from the scanning beam by one of the interlayer units results in emission of electromagnetic radiation in a longer wavelength region. For economy of expression each interlayer unit that absorbs scanning radiation and emits longer wavelength radiation is referred to simply as an emissive interlayer unit, since it is inherent that energy must first be absorbed before emission can occur. Emission from the interlayer unit is modulated by developed silver in the exposure recording emulsion layer unit or units the scanning beam penetrates. Developed silver absorption of the scanning beam before it reaches the emissive interlayer unit prevents emission from occurring in areas that contain developed silver, and the developed silver also intercepts and absorbs any emission from the interlayer unit that may be laterally directed into these areas.

The remaining interlayer unit can be either reflective or absorptive. When the remaining interlayer unit is reflective, modulation of a scanning beam directed toward the interlayer unit by the emulsion layer unit or units the scanning beam penetrates is again performed by the developed silver. In areas in which the scanning beam does not encounter developed silver it is reflected from the interlayer unit for detection and recording. In other areas the scanning beam is intercepted and absorbed by the developed silver. This type of interlayer unit is hereinafter referred to as a reflective interlayer unit .

When the remaining interlayer unit is absorptive, it can be an emissive interlayer unit of the type described above that absorbs electromagnetic radiation in one wavelength region and emits electromagnetic radiation in a longer wavelength region. When one or more emissive interlayer units are employed, it is immaterial whether the interlayer unit also exhibits significant reflectance. When the wavelengths of scanning radiation and emitted radiation are both within the detection bandwidth of the retroscan, reflection from the emissive interlayer unit can supplement the emission in providing a detection signal. When the wavelength shift between absorption and emission (the Stokes shift) is larger than the bandwidth of the detector, any reflected radiation may go undetected and perform no useful role in scanning.

Instead of being an absorptive interlayer unit that is emissive (i.e., an emissive interlayer unit) the absorptive interlayer unit can be absorptive while exhibiting no emission or no significant emission within a detection bandwidth of interest. For economy of expression this type of interlayer unit construction is referred to as a passive absorptive interlayer unit, while the term absorptive interlayer unit is employed to designate passive absorptive and emissive interlayer units collectively. Using a passive absorptive interlayer unit for retroscanning the low levels of reflection from developed silver are used to provide scan image information. Developed silver absorbs most of the light it receives, but it is capable of reflecting a small percentage of that light, typically about 5 percent. When a reflective or emissive interlayer unit is employed as described above, light absorption by developed silver is sufficiently high and light reflection by developed silver is sufficiently low in relation to reflection or emission from the interlayer unit that the reflectance of developed silver is negligible and therefore ignored in the discussion. However, when the developed silver is scanned against an interlayer unit that neither reflects nor emits light, the low levels of reflectance from developed silver are sufficient to provide a detectable image.

An important point to notice is that, regardless of which combination of interlayer units is chosen, both of the interlayer units must be capable of specularly transmitting radiation to the underlying emulsion layer unit or units during imagewise exposure. Further, both of the interlayer units must be penetrable by the scanning beam used for overall scanning through all emulsion layer units and interlayer units.

When the light transmission requirements of the interlayer units are taken into account, it is apparent that each interlayer unit must be capable of specularly transmitting light within the spectral wavelength region or regions which underlying emulsion layer unit or units are intended to record. Both interlayer units must be capable of transmitting light within a common wavelength region during overall scanning. At least one interlayer unit must be capable of absorbing and emitting light during retroscanning, and the remaining interlayer unit must be capable of reflecting or absorbing (either passively or accompanied by emission) electromagnetic radiation from a scanning beam during retroscanning.

Both the light transmission and absorption requirements of the passive absorptive interlayer unit can be readily achieved by dissolving or dispersing an appropriate dye or dye precursor in a conventional photographic vehicle. A simple construction is to employ a dye in the absorptive interlayer unit that exhibits minimal or near minimal absorption of light during imagewise exposure in the wavelength region or regions that the underlying emulsion layer unit or units are intended to record and that exhibits peak or near peak absorption in another wavelength region that is used for scanning. Another alternative is to employ a dye precursor that absorbs during imagewise exposure little, if any, of the light which the underlying emulsion layer unit or units are intended to record, with the dye precursor being converted after imagewise exposure to a dye exhibiting an absorption peak in a wavelength region in which retroscanning is conducted. Stated in a more quantitative way, the dye employed, whether preformed or formed in situ, is chosen to exhibit a half-peak absorption bandwidth that occupies the spectral region within which absorption for scanning is needed. Overall scanning can be conducted in a wavelength region within which the dye exhibits minimal or near minimal absorption—i.e., outside the half-peak absorption bandwidth of the dye.

Achieving the light absorption requirements of the passive absorptive interlayer unit is compatible with retaining the specularly transmissive and non-reflective characteristics of conventional photographic element interlayer unit constructions. Preferred selections are from among a wide variety of dyes and dye precursors that have real component refractive indices essentially similar to the photographic layer vehicle in which they are dissolved or dispersed (e.g., preferably differing by $<\pm 0.2$, most preferably $<\pm 0.1$).

A refractive index contains a real component, herein also referred to as a diffraction representing component, (n) that is related to light defraction and an imaginary component, herein also referred to as an absorption representing component, (ik) that is related to light absorption. For simplicity of expression subsequent references are to refractive index with the parenthetic term (n) and/or (ik) being used to indicate the component being discussed. Nonabsorbing materials (e.g., white and transparent materials) have no significant absorption representing component (ik).

Given the performance criteria above the selection of photographic vehicles, dyes and dye precursors for forming the passive absorptive interlayer unit can be readily achieved by those familiar with silver halide photographic element construction. Conventional photographic vehicles are illustrated by Research Disclosure, Vol. 308, December 1989, Item 308119, Section IX, the disclosure of which is here incorporated by reference. Hydrophilic colloids, particularly gelatin and gelatin derivatives are preferred vehicle materials. The dye precursors are preferably selected from among conventional dye-forming couplers, such as those set out in Item 308119, Section VII, here incorporated by reference. Any preformed dye that remains stable through photographic development and fixing can be employed. Such dyes include, but are not limited to, the types of dyes, typically azo dyes, that are formed by coupling reactions (e.g., the type of dye that is conventionally formed during color development can be used as a preformed dye). To avoid refractive index (n) mismatches and hence light scattering it is preferred to avoid microcrystalline dyes in constructing the absorptive interlayer unit.

To provide an interlayer unit that is efficiently reflective it is necessary that the reflection scanning beam encounter a phase boundary of two media whose refractive indices (n) differ by $>0.2$, preferably at least 0.4 and optimally at least 1.0. The simplest way of satisfying this requirement is to create a two phase interlayer unit in which a discrete phase having a refractive index ($n_d$) is dispersed in a continuous phase having a refractive index ($n_c$), where the difference between $n_d$ and $n_c$ is $>0.2$, preferably $\geqq 0.4$ and optimally $\geqq 1.0$. The continuous phase preferably takes the form of a conventional photographic vehicle noted above. Gelatin, a typical photographic vehicle with a typical refractive index, is disclosed by James The Theory of the Photographic Process, 4th Ed., Macmillan, New York, 1977, p. 579, FIG. 20.2, to have a refractive index (n) ranging from 1.55 to 1.53 within the visible spectrum. Gases have refractive indices (n) of 1.0. One technique for creating a reflective interlayer unit is to disperse gas discretely in the interlayer unit. This can easily be accomplished by incorporating conventional hollow beads in a photographic vehicle. Since organic polymers generally and those commonly used to form hollow beads in particular have refractive indices that differ from that of gelatin by $<\pm 0.1$, it is apparent that the preferred $\geqq 0.4$ refractive index (n) difference between the gas and the surrounding bead walls for efficient reflection is readily achieved. When inorganics are employed for bead construction, even larger refractive index (n) differences are available.

In a simpler construction the discrete phase can be provided by solid inorganic particles. A wide variety of inorganic particles compatible with silver halide photographic elements are available having a refractive index (n) of greater than 1.0 and, more typically, greater than 2.0. For example, Marriage U.K. Patent 504,283, April 21, 1939, the disclosure of which is here incorporated by reference, discloses mixing with silver halide emulsions inorganic particles having refractive indices of "not less than about 1.75." Marriage discloses the oxide and basic salts of bismuth, such as the basic chloride or bromide or other insoluble bismuth compounds (refractive indices, n, about 1.9); the dioxides of titanium (n=2.7), zirconium (n=2.2), hafnium or tin (n=2.0), calcium titanate (n=2.4), zirconium silicate (n=1.95), and zinc oxide (n=2.2) as well as cadmium oxide, lead oxide and some white silicates. Yutzy and Carroll U.K. Patent 760,775, cited above and here incorporated by reference, also discloses barium sulfate (baryta). It is also recognized that silver halide grains are capable of providing the refractive index (n) differences required for reflection.

A number of approaches are available for providing an interlayer unit or interlayer units satisfying scanning reflectance requirements as well as the requirement of substantially specular transmission during imagewise exposure and during the overall scan.

A starting point is to recognize that the silver halide emulsions used for photographic imaging contain grains that exhibit significant light scattering. The light scattering of latent image forming silver halide grains as compared to Lippmann emulsions, which have grains too small for useful latent image formation, typically 0.05 micrometer (μm), is well known. It is possible to employ an interlayer unit that is as specularly transmissive as a conventional silver halide emulsion layer while at the same time obtaining reflectances that exceed minimum requirements for scanning. As discussed in detail below, it is in fact possible to employ in the interlayer unit silver halide grains for light scattering that are capable of remaining after fixing has removed silver halide grains from the emulsion layer units used for recording imagewise exposure. While it is generally preferred that a minimum reflection efficiency of about 10 percent be exhibited by each reflective interlayer unit, it is recognized that increasing the reflection scanning beam intensity can be used to compensate for reflection inefficiencies.

To improve transmission and/or reflection characteristics of a reflective interlayer unit wavelength regions for exposure, overall scanning and reflection scanning can be selected such that the refractive index (n) differences in the region of reflection scanning are greater than refractive index (n) differences in wavelength regions intended to transmit imagewise exposure and/or overall scanning light. This is possible because refractive indices vary as a function of wavelength. For example, James, FIG. 20.2, noted above, plots the refractive indices (n) of AgCl , AgBr and AgI relative to the refractive index (n) of gelatin over the visible spectrum, showing that the differences decrease with increasing wavelengths. This suggests performing the overall scan in the infrared region of the spectrum and performing the reflection scan in the blue region of the spectrum when silver halide grains are relied upon for the refractive index (n) difference in the reflective interlayer unit. Although different wavelength region selections may be dictated, the same principles apply to other discrete phase reflective interlayer unit materials. Scanning wavelength selections as described are fully compatible with other approaches for rationalizing reflection and transmission characteristics.

An approach that is effective to improve the specularity of transmission during imagewise exposure through the interlayer unit relied upon for reflection during scanning is to form the discrete phase after imagewise exposure has occurred and before scanning. For example, the formation of titania particles in situ during photographic processing under alkaline conditions, which are required for development, in a photographic element containing titanyl oxalate is taught in Research Disclosure, Vol. 111, July 1973, Item 11128, the disclosure of which is here incorporated by reference. The metal salt of the organic acid as initially coated exhibits a refractive index approximating that of the photographic vehicle in which it is coated, whereas the subsequently formed titania has a refractive index (n) of >2.0. Additionally, Marriage U.K. Patent 504,283, incorporated by reference above, discloses similar procedures for forming the reflective particles within the emulsion layers. Although Marriage contemplates forming the particles before imagewise exposure, the same principles can be used to form the particles after imagewise exposure.

It is also possible to employ wavelength dependent effects to maximize or minimize reflection within a selected wavelength region. By controlled dimensional choices of the particles forming the discrete phase of the reflective layer reflection can be maximized or minimized in a selected wavelength region. Although reflection maxima and minima have been observed with particles of many different compositions, the most convenient particles to employ in photographic element construction are silver halide grains, since controlling the size, size-frequency distribution (dispersity) and shape of silver halide grains has been extensively studied. Grain dispersity is often characterized using the terms "monodispersed" or "polydispersed". The latter term typically refers to a broad log normal (Gaussian) size-frequency distribution of grains and is here applied to any grain size distribution that is not monodispersed. The term "monodispersed" refers to a more restricted size-frequency distribution and is typically and herein employed to indicate a size-frequency distribution that exhibits a coefficient of variation (COV) based on grain size (equivalent circular diameter or ECD) of less than 20 percent, where $COV_{ECD}$ is the standard deviation of the grain size distribution divided by the mean grain ECD and multiplied by 100. The equivalent circular diameter of a grain is the diameter of a circle having the same projected area as the grain.

As demonstrated by Research Disclosure, Item 13452, cited above and here incorporated by reference, monodispersed nontabular silver halide grains exhibit well defined reflectance maxima in the visible region of the spectrum when mean grain sizes (ECD's) are in the range of from 0.1 to 0.6 μm. For example, to obtain maximum reflectance in the blue region of the spectrum monodispersed nontabular silver halide grains having a mean ECD in the range of from about 0.1 to 0.3 μm represent an excellent choice. These grains exhibit relatively low levels of reflectance in the green, red and near infrared regions of the spectrum. For maximum red reflectance monodispersed nontabular silver halide grains having a mean ECD in the range of from about 0.5 to 0.8 μm represent an excellent choice. Monodispersed nontabular silver halide grains of intermediate ECD's ranging from 0.3 to 0.5 μm can be selected for maximum green reflectance.

Another approach for constructing a spectrally selective reflective interlayer unit is to employ as the discrete particulate phase silver halide grains wherein greater than 90 percent of the total grain projected area is accounted for by tabular grains having a mean ECD greater than 0.4 μm and a mean tabular grain thickness (t) in the range of from 0.07 to 0.2 μm and a tabular grain coefficient of variation based on thickness ($COV_t$) of less than 15 percent. Within these selection criteria tabular grains with mean thicknesses in the range of from about 0.12 to 0.20 μm exhibit maximum levels of blue reflectance while exhibiting minimal reflectance in the green or red region of the spectrum. Tabular grains with mean thicknesses in the range of from about 0.10 to 0.12 μm exhibit maximum reflectances in the red region of the spectrum with significantly lower reflectances in the green region of the spectrum. Tabular grains with mean thicknesses in the range of 0.07 to 0.10 μm exhibit maximum reflectances in the red and green regions of the spectrum. Tabular grain emulsions satisfying these selection criteria and their preparation are disclosed by Nakamura et al U.S. Pat. No. 5,096,806 and Tsaur et al U.S. Pat. No. 5,147,771, 5,147,772, 5,147,773 and 5,171,771, the disclosures of which are here incorporated by reference.

To rely on silver halide grains to reflect light during reflection scanning it is, of course, necessary to employ grains that are capable of remaining in the photographic element following photographic development and fixing. Development is required to form an image. Fixing is undertaken to remove undeveloped silver halide grains from the exposure recording emulsion layer units, thereby avoiding unwanted reflections from within these layers during overall scanning. Although it is possible that fixing could be eliminated by selection of all the silver halide grain populations in the photographic element to satisfy the optical criteria required for efficient scanning, it is preferred to remove the grain populations of the image recording emulsion layer units before scanning, thereby allowing the full range of image recording emulsion layer unit constructions employed in conventional multicolor photographic elements.

For photographic imaging cubic crystal lattice silver halide grains are almost universally employed for latent image formation. (The cubic crystal lattice should not be confused with the overall grain shape, which may be but most frequently is not cubic.) Silver ions in combination with all relative proportions of chloride and bromide ions form cubic crystal lattices. A minor amount of iodide ions, ranging up to about 40 mole percent for silver bromoiodide emulsions, can be accommodated within the cubic crystal lattice.

High iodide (>90 mole percent iodide, based on silver) silver halide grains (typically available in the crystalline forms of β and γ phase silver iodide) exhibit solubilities that are approximately two orders of magnitude lower than those of silver bromide and approximately four orders of magnitude lower than those of silver chloride. Since high iodide grains are known to respond to development only under a few selected conditions and are much less soluble than latent image forming cubic crystal lattice grains, high iodide grains represent one preferred grain choice for construction of the reflective interlayer units.

Another approach is to employ cubic crystal lattice silver halide grains that are surface passivated (i.e., resistant to development and fixing) in the reflective interlayer units. Surface passivation can be achieved by modifying the grain or its surface boundary to prevent development and fixing. Grains that form internal latent images are nondevelopable in a surface developer (a developer lacking a significant level of solvent or iodide ion), and this represents one available approach to preventing development. Another well known technique for preventing the photographic response of a silver halide grain is to adsorb a desensitizer to its surface. Examples of dyes that desensitize negative-working silver halide emulsions are set in Research Disclosure, Item 308119, cited above, Section IV., sub-section A, paragraph G, while non-dye desensitizers are disclosed in Section IV, sub-section B, the disclosures of which are here incorporated by reference. Shelling cubic crystal lattice silver halide grains with silver iodide represent an effective approach to surface passivation. Surface passivation can also be achieved by adsorbing to the grain surfaces carbazole, tetraalkyl quaternary ammonium salts containing at least one long (>10 carbon atoms) chain alkyl group, a cyclic thiourea or bis[2-(5-mercapto)-1,3,4-thiadiazolyl]sulfide, based on solubilization resistance to alkali thiosulfate fixing, with and without light exposure, reported by A. B. Cohen et al, "Photosolubilization of Silver Halides II. Organic Reactants", Photographic Science and Engineering, Vol. 9, No. 2, March-April 1965, pp. 96-103, the disclosure of which is here incorporated by reference. Because the adsorbed species relied upon for surface passivation adsorb tightly to the grain surfaces and exhibit low solubilities (i.e., silver salt solubility product constants $<10^{-12}$ and preferably less than $10^{-14}$), it is possible to surface passivate the interlayer unit silver halide grains without objectionably affecting the photographic performance of the silver halide grains in the image recording emulsion layer units.

It is, of course, recognized that the discrete phase of the reflective interlayer unit, though carefully selected to satisfy all of the criteria set forth above, may nevertheless be unattractive for use if it absorbs a high percentage of light in the wavelength region of reflection scanning. For example, developed silver exhibits a refractive index (n) of 0.075 and therefore satisfies the preferred refractive index (n) difference of ≧0.4 when dispersed in gelatin. However, the absorption related component (ik) of the refractive index in the visible spectrum (400 to 700 nm) of silver is quite high, as is to be expected, since it appears black. The absorption related component (ik) of the refractive index of silver ranges from 2 to 4.6 in the visible spectrum. While it is possible to construct a reflective interlayer unit of any material that exhibits a reflection distinguishably larger than the low reflectivity of imagewise developed silver, it is preferred to choose discrete phase materials of low absorptions in reflection scanning wavelength regions. It is generally preferred that the absorption related component (ik) of the refractive index of discrete phase components of the reflective interlayer units be less than 0.01 in the wavelength region of reflection scanning.

In Table I below the diffraction related (n) and absorption related (ik) components of the refractive index of discrete phase materials preferred for use in the reflective interlayer units as well as those of silver are set out.

TABLE I

| Discrete Phase | n | ik | Wavelengths (nm) |
|---|---|---|---|
| $TiO_2$ | 2.6–2.9 | <0.001 | 400–700 |
| $BaSO_4$ | 1.64 | <0.001 | 400–700 |
| AgCl | 2.05–2.1 | <0.001 | 400–700 |
| AgBr | 2.22–2.38 | <0.005 | 400–700 |
| AgI | 2.15–2.3 | 0.005 | 450–700 |

TABLE I-continued

| Discrete Phase | n | ik | Wavelengths (nm) |
|---|---|---|---|
| $Ag^o$ | 0.075 | 2–4.6 | 400–700 |

It is, of course, possible to utilize light absorption by a reflective interlayer unit to advantage. For example, if the reflective interlayer unit overlies one or more emulsion layer units provided to record green or red light exposures but also exhibiting significant unwanted native sensitivity to blue light and if the interlayer unit is reflection scanned outside the blue region of the spectrum, choosing a reflective interlayer unit that absorbs blue light is advantageous in protecting the underlying emulsion layer unit or units from unwanted blue exposure and does not diminish the reflectivity of the interlayer unit when scanned outside the blue region of the spectrum. Silver iodide and silver bromoiodide are examples of discrete phase choices for the interlayer unit. Referring to Table I above, silver iodide is noted to have a low absorption related component in the green and red (500 to 700 nm) regions of the spectrum. However, the absorption related component (ik) of the refractive index of silver iodide rises steeply in shifting toward wavelengths of <450 nm.

In the discussion above the reflective interlayer unit has been described as being unitary—that is, of the same composition throughout its thickness. In one preferred form of the invention the reflective interlayer unit is a composite interlayer unit comprised of two sub-layers, one sub-layer being relied upon for reflection and the second being relied upon for absorption. The reflective sub-layer can be identical to any of the unitary reflective interlayer units previously described. This sub-layer is located to receive light during reflection scanning prior to the absorptive sub-layer. The absorptive sub-layer can be constructed as described above in connection with the absorptive interlayer units. Although the absorptive sub-layer can perform other useful functions, a primary function that the absorptive sub-layer performs is to enhance the quality of the image information obtained during the reflection scan utilizing reflection from the reflective sub-layer. This is accomplished by minimizing or eliminating penetration of the reflecting interlayer unit by the reflection scanning beam. If a portion of the reflection scanning beam penetrates the reflective interlayer unit, it may be reflected at one or more underlying interlayers and returned to the reflection scan detector to degrade the image record sought to be determined. Alternatively, it may produce unwanted excitation of another interlayer, again degrading the image record sought to be determined. Except for the additional capability of absorbing light from the reflection scanning beam that is not reflected the composite reflective interlayer unit is identical in its performance properties to the unitary reflective interlayer unit elsewhere described.

In one preferred form of the invention the absorptive sub-layer of the reflective interlayer unit can provide a uniform distribution of silver to absorb light. A simple way of accomplishing this is to form the absorptive sub-layer of a spontaneously developable silver halide emulsion, preferably one chosen so that the silver halide grains exhibit minimum scattering of exposing radiation. For example, the absorptive sub-layer can contain a Lippmann emulsion during imagewise exposure of the photographic element. The silver halide grains of the Lippmann emulsion are too small to scatter light to any significant degree during exposure. During photographic processing the Lippmann emulsion grains can be uniformly reduced to silver. This can be achieved by surface fogging the Lippmann emulsion grains before coating or by incorporating a conventional immobile (ballasted or grain-adsorbed) nucleating agent in the Lippmann emulsion layer. Examples of hydrazine and hydrazide nucleating agents, a preferred class of nucleating agents, are provided in Research Disclosure, Vol. 235, November 1983, Item 23510, and Vol. 151, November 1976, Item 15162, the disclosures of which is here incorporated by reference.

In constructing emissive interlayer units emissive components (e.g., dyes or pigments) are dissolved or dispersed in a conventional photographic vehicle. Except for the emissive component, the emissive interlayer unit construction can be similar to that of the reflective or passive absorptive interlayer units described above. The emissive component can be substituted for the dye or dye precursor in the passive absorptive interlayer unit construction. In the reflective interlayer unit construction the emissive component can be substituted for the discrete phase component or, to immobilize the emissive component, adsorbed to the particle surfaces of the discrete phase component.

As has been noted above, reflection from the emissive interlayer unit during retroscanning can be used to advantage. The same approaches described above for the passive absorptive and unitary reflective interlayer unit constructions can be employed to minimize light scatter during imagewise exposure and overall scanning. To minimize light scatter it is preferred that the emissive component be dissolved in the photographic vehicle or blended in a photographic vehicle of similar refractive index (e.g., emissive component and vehicle real component refractive indices differing by $<\pm 0.2$, most preferably $<\pm 0.1$). When the emissive component is dispersed as solid particles, particularly when the emissive component and vehicle refractive indices (n) differ significantly, it is preferred to select particle sizes to minimize light scatter. The size selections as a function of light wavelength discussed above for silver halide particles can also be applied to reflective emissive component particles.

The emissive components of the emissive interlayer units of the invention can be selected from among a wide variety of materials known to absorb light in a selected wavelength region and to emit light in a longer wavelength region. In Table II examples of preferred emissive components are provided. The spectral regions are indicated within which peak absorption (excitation) (Exc) and peak emission (Em) are located, where UV indicates the near ultraviolet (300 to 400 nm) spectral region and NIR indicates the near infrared (preferably 700 to 900 nm) spectral region. Where two spectral regions are indicated (e.g., UV/Blue) the half-peak bandwidth traverses the shared boundary of the spectral regions.

TABLE II

| | |
|---|---|
| EC-1 | p-Quaterphenyl (Exc UV, Em UV) |
| EC-2 | 2-(1-Naphtyl)-5-phenyloxazole (Exc UV, Em UV/Blue) |
| EC-3 | 2,2'-p-Phenylenebis(5-phenyloxazole) (Exc UV, Em Blue) |
| EC-4 | 2,2'-p-Phenylenebis(4-methyl-5-phenyloxazole) (Exc UV, Em Blue) |

TABLE II-continued

| | |
|---|---|
| EC-5 | 7-Amino-4-methyl-2-quinolinol (Exc UV, Em Blue) |
| EC-6 | 7-Dimethylamino-4-methylcarbostyril (Exc UV, Em Blue) |
| EC-7 | p-Bis(o-methylstyryl)benzene (Exc UV, Em Blue) |
| EC-8 | 7-Diethylamino-4-methylcoumarin (Exc UV, Em Blue) |
| EC-9 | 4,6-Dimethyl-7-ethylaminocoumarin (Exc UV, Em Blue) |
| EC-10 | 4-Methylumbelliferone (Exc UV, Em Blue) |
| EC-11 | 7-Amino-4-methylcoumarin (Exc UV, Em Blue) |
| EC-12 | 7-Dimethylaminocyclopenta[c]coumarin (Exc UV, Em Blue) |
| EC-13 | 7-Amino-4-trifluoromethylcoumarin (Exc UV, Em Blue) |
| EC-14 | 4-Methyl-7-(sulfomethylamino)coumarin, sodium salt (Exc UV, Em Blue) |
| EC-15 | 7-Dimethylamino-4-methylcoumarin (Exc UV, Em Blue) |
| EC-16 | 4-Methylpiperidino[3,2-g]coumarin (Exc UV, Em Blue) |
| EC-17 | Tris(1-phenyl-1,3-butanedionol)terbium(III) (Exc UV, Em Green) |
| EC-18 | 2-(2-Hydroxyphenyl)benzoxazole (Exc UV, Em Green) |
| EC-19 | 2-(2-Tosylaminophenyl)-4H-3,1-benzoxazin-4-one (Exc UV, Em Green) |
| EC-20 | Europium (III) thenoyltrifluoroacetonate, 3-hydrate (Exc UV, Em Red) |
| EC-21 | 5-(4-Dimethylaminobenzylidene) barbituric acid (Exc UV, Em Red) |
| EC-22 | α-Benzoyl-4-dimethylaminocinnamonitrile (Exc UV, Em Red) |
| EC-23 | Nonyl 4-[4-(2-benzoxazolyl)styryl]benzoate (Exc UV/Blue, Em Blue) |
| EC-24 | 7-Dimethylamino-4-trifluoromethylcoumarin (Exc UV/Blue, Em Green) |
| EC-25 | 4-Trifluoromethylpiperidino[3,2-g]coumarin (Exc UV/Blue, Em Green) |
| EC-26 | 2,2'-Dihydroxy-1,1'-naphthaldiazine (Exc UV/Blue, Em Green) |
| EC-27 | 1,2,4,5,3H,6H,10H-Tetrahydro-9-carbethoxy(1)benzopyrano(9,9a,1-g)quinolizin-10-one (Exc Blue, Em Blue/Green) |
| EC-28 | 9-Acetyl-1,2,45,-3H,6H,10H-tetrahydrol[1]-benzopyrano(9,9a,1-gh)quinolizin-10-one (Exc Blue, Em Green) |
| EC-29 | 9-Cyano-1,2,4,5,-3H,6H,10H-tetrahydrol[1]-benzopyrano(9,9a,1-gh)quinolizin-10-one (Exc Blue, Em Green) |
| EC-30 | 9-(tert-Butoxycarbonyl)-1,2,4,5-3H,6H,10H-tetrahydro[1]benzopyrano(9,9a,1-gh)quinolizin-10-one (Exc Blue, Em Blue/Green) |
| EC-31 | 7-Amino-3-phenylcoumarin (Exc UV/Blue, Em Blue/Green) |
| EC-32 | 7-Diethylamino-4-trifluoromethylcoumarin (Exc UV/Blue, Em Blue/Green) |
| EC-33 | 2,3,5,6-1H,4H-Tetrahydro-8-methylquinolazino[9,9a,1-gh]coumarin (Exc UV/Blue, Em Blue/Green) |
| EC-34 | 3-(2'-Benzothiazolyl)-7-diethylaminocoumarin (Exc Blue, Em Green) |
| EC-35 | 3-(2'-Benzimidazolyl)-7-N,N-diethylaminocoumarin (Exc Blue, Em Green) |
| EC-36 | 3-(2'-N-Methylbenzimidazolyl)-7-N,N-diethylaminocoumarin (Exc Blue, Em Green) |
| EC-37 | 1,2,4,5,3H,6H,10H-Tetrahydro-8-trifluoromethyl(1)benzopyrano(9,9a,1-gh)quinolizin-10-one (Exc Blue, Em Green) |
| EC-38 | 7-Ethylamino-6-methyl-4-trifluoromethylcoumarin (Exc Blue, Em Green) |
| EC-39 | 9-Carboxy-1,2,4,5-3H,6H,10H-tetrahydro[1]-benzopyrano(9,91,1-g)quinolizin-10-one (Exc Blue, Em Green) |
| EC-40 | N-Ethyl-4-trifluoromethylpiperidino[3,2-g]coumarin (Exc Blue, Em Green) |
| EC-41 | 8-Hydroxy-1,3,6-pyrene-trisulfonic acid, trisodium salt (Exc Blue, Em Green) |
| EC-42 | 3-Methoxybenzanthrone (Exc Blue, Em Green) |
| EC-43 | 4'-Methoxy-1,8-naphthyolene-1',2'-benzimidazole (Exc Blue, Em Green) |
| EC-44 | 4-(Dicyanomethylene)-2-methyl-6-(p-dimethylaminostyryl)-4H-pyran (Exc Blue, Em Red) |
| EC-45 | N-Salicylidene-4-dimethylaminoaniline (Exc Blue, Em Red) |
| EC-46 | 9-(o-Carboxyphenyl)-2,7-dichloro-6-hydroxy-3H-xanthen-3-one (Exc Blue/Green, Em Green) |
| EC-47 | Methyl o-(6-amino-3-imino-3H-xanthen-9-yl)benzoate monohydrochloride (Exc Green, Em Green) |
| EC-48 | o-(6-Amino-3-imino)-3H-xanthen-9-yl)benzoic acid hydrochloride (Exc Green, Em Green) |
| EC-49 | o-[6-(Methylamino)-3-(methylimino)-3H-xanthen-9-yl]benzoic acid (Exc Green, Em Green) |
| EC-50 | o-[6-(Ethylamino)-3-(ethylimino)-2,7-dimethyl-3H-xanthen-9-yl-]benzoic acid (Exc Green, Em Green) |
| EC-51 | Ethyl o-[6-(ethylamino)-3-(ethylimino)-2,7-dimethyl-3H-xanthen-9-yl-]benzoate perchlorate (Exc Green, Em Green/Red) |
| EC-52 | Ethyl o-[6-(ethylamino)-3-(ethylimino)-2,7-dimethyl-3H-xanthen-9-yl]benzoate tetrafluoroborate (Exc Green, Em Green/Red) |
| EC-53 | [6-(Diethylamino)-3H-xanthen-3-yl]diethylammonium perchlorate (Exc Green, Em Red) |
| EC-55 | [9-(o-Carboxyphenyl)-6-(diethylamino)-3H-xanthen-3-ylidene]diethylammonium chloride (Exc Green, Em Red) |
| EC-56 | o-[6-(Dimethylamino)-3-(dimethylimino)-3H-xanthen-9-yl]benzoic acid perchlorate (Exc Green, Em Red) |
| EC-57 | 3-Ethyl-2-[5-(3-ethyl-2-benzoxazolinylidene-1,3-pentadienyl]benzoxazolium iodide (Exc Green, Em Red/NIR) |
| EC-58 | 5,9-Diaminobenzo(a)phenoxazonium perchlorate (Exc Green/Red, Em Red/NIR) |
| EC-59 | N-{6-(Diethylamino)-9-[2-(ethoxycarbonyl)phenyl-3H-xanthen-3-ylidene}-N-ethylethanaminium perchlorate (Exc Green, Em Red) |
| EC-60 | 3-(diethylamino)-6-(diethylimino)-9-(2,4-disulfophenyl)xanthylium hydroxide, inner salt (Exc Green, Em Red) |
| EC-61 | 8-(2,4-Disulfophenyl)-2,3,5,6,11,12,14,15-1H,4H,10H,13H-octahydrodiuinolizino[9,9a,1-bc;9,9a,1-hi]xanthanylium hydroxide inner salt (Exc Green, Em Red/NIR) |
| EC-62 | 3,7-Bis(ethylamino)-2,8-dimethylphenoxazin-5-ium perchlorate (Exc Green/Red, Em Red/NIR) |
| EC-63 | 3,7-Bis(diethylamino)phenoxazonium perchlorate (Exc Red, Em Red/NIR) |
| EC-64 | 9-Ethylamino-5-ethylimino-10-methyl-5H-benzo(a)phenoxazonium perchlorate (Exc Red, Em Red/NIR) |
| EC-65 | 1-Phenyl-5-(4-methoxyphenyl)-3-(1,8-naphtholene-1',2'-benzimidazolyl-4)-2-pyrazoline (Exc Green, Em Red/NIR) |
| EC-66 | 5-Amino-9-diethylaminobenzyl[a]phenoxazolium perchlorate (Exc Red, Em Red) |
| EC-67 | Ethyl-1-[5-(3-ethyl-2-benzothiazolinylidene)-1,3-pentadienyl]benzothiazolium iodide (Exc Red, Em NIR) |
| EC-68 | 3-Ethyl-2-[7-(3-ethyl-2-benzoxazolinylidene)-1,3,5-heptatrienyl]benzoxazolium iodide (Exc Red, Em NIR) |
| EC-69 | 1,1'-Diethyl-4,4'-carbocyanine iodide (Exc Red/NIR, Em NIR) |
| EC-70 | 2-[5-(1,3-Dihydro-1,3,3-trimethyl-2H-indol-2-ylidene)-1,3-pentadienyl]-1,3,3-trimethyl-3H-indolium iodide (Exc Red, Em NIR) |
| EC-71 | 2-[7-(1,3-Dihydro-1,3,3-trimethyl-2indol-2-ylidene)-1,3,5-heptatrienyl]-1,3,3-trimethyl-3indolium perchlorate (Exc Red/NIR, Em NIR) |
| EC-72 | 2-[7-(1,3-Dihydro-1,3,3-trimethyl-2H-indol- |

TABLE II-continued

| | |
|---|---|
| | 2-ylidene)-1,3,5-heptatrienyl]-1,3,3-trimethyl-3H-indolium iodide (Exc Red/NIR, Em NIR) |
| EC-73 | 3-Ethyl-2-[7-(3-ethyl-2-benzothiazolinylidene)-1,3,5-heptatrienyl]benzothiazolium iodide (Exc Red/NIR, Em NIR) |
| EC-74 | 3-Ethyl-2-[7-(3-ethyl-2-benzothiazolinylidene)-1,3,5-heptatrienyl]benzothiazolium perchlorate (Exc Red/NIR, Em NIR) |
| EC-75 | IR-144 (Exc Red/NIR, Em NIR) |
| EC-76 | 1,1',3,3,3',3'-Hexamethyl-4,4',5,5'-dibenzo-2,2'-indotricarbocyanine perchlorate (Exc Red/NIR, Em NIR) |
| EC-77 | 5,5'-Dichloro-11-diphenylamino-3,3'-diethyl-10,12-ethylenethiatricarbo-cyanine perchlorate (Exc Red/NIR, Em NIR) |
| EC-78 | Anhydro-11-(4-ethoxycarboylpiperazin-1-yl)-10,12-ethylene-3,3,3',3'-tetramethyl-1,1'-bis(3-sulfopropyl)-4,5,4',5'-dibenzoindotricarbocyanine hydroxide triethylamine salt (Exc Red/NIR, Em NIR) |
| EC-79 | 3,3'-Di(3-acetoxypropyl)-11-diphenyl-amino-10,12-ethylene-5,6,5',6'-dibenzothiatricarbocyanine perchlorate (Exc Red/NIR, Em NIR) |
| EC-80 | Anhydro-1,1-dimethyl-2-(7-[1,1-dimethyl-3-(4-sulfobutyl)-2-(1H)-benz(e)indolinylidene]-1,3,5-heptatrienyl}-3-(4-sulfobutyl)-1H-benz(e)indolium hydroxide sodium salt (Exc Red/NIR, Em NIR) |

In contrast to the image pattern of emissive components of Shumann et al U.S. Pat. No. 4,543,308, cited above, the emissive components are chosen to be retained uniformly in the emissive interlayer unit following imagewise exposure and photographic processing of the photographic element. The most convenient approach is to employ emissive components dissolved in high boiling water-immiscible solvents dispersed in an aqueous hydrophilic colloid solution. Alternatively, a dispersion of solid emissive components can be used. The high boiling solvents may be those solvents known for preparing dispersions of color couplers and generally referred to a coupler solvents. Emissive components that are soluble in nonaqueous media can in many instances be incorporated into the types of polymeric lattices commonly employed as vehicle extenders in photographic vehicles. Vehicle extenders are disclosed in Research Disclosure, Item 308119, cited above, Section IX, paragraphs B and C, here incorporated by reference. It is also possible to introduce insoluble emissive components into the emissive interlayer unit as particles. When the emissive particles exhibit refractive indices (n) that differ from those of the coating vehicle by $<\pm 0.2$ and preferably $<\pm 0.1$, the emissive interlayer unit exhibits acceptable specular transmission during imagewise exposure independent of the particle sizes selected. When the refractive indices of the emissive component particles and the surrounding vehicle differ by $>\pm 0.2$, it is preferred to maintain particle sizes within the size ranges described above for minimizing light scattering by silver halide grains. When the chromophoric portion of an emissive component exhibits significant solubility in photographic processing solutions, wandering of the emissive component from the emissive interlayer unit can be prevented by synthetically attaching a ballasting group of the type commonly found in incorporated dye-forming couplers to minimize mobility. Ionic emissive components can also be immobilized by associating the emissive component with a polymeric mordant. A variety of polymeric mordants useful in immobilizing dyes in photographic elements are disclosed in Research Disclosure, Item 15162, cited above, the disclosure of which is here incorporated by reference.

Just as the reflective interlayer unit can be either a uniform reflective interlayer unit or a composite reflective interlayer unit it is also contemplated that the emissive interlayer unit can be either a unitary emissive interlayer unit of the structure described above of uniform composition throughout its thickness or a composite emissive interlayer unit. When the emissive interlayer unit is a composite emissive interlayer unit, it is comprised of an emissive sub-layer identical to the unitary emissive interlayer unit construction described above and an absorptive sub-layer. The absorptive sub-layer can take the same form as the absorptive sub-layer of the reflective interlayer unit described above and can perform the same functions. When the photographic element to be scanned contains two emissive interlayer units that are both excited (absorb) within one spectral region of scanning and that emit in the same or overlapping spectral wavelength regions, it is preferred that one or both of the emissive interlayer units be constructed as composite interlayer units. The absorptive sub-layer or sub-layers by being chosen to absorb light within the half peak bandwidth of retroscanning optically isolate the emissive interlayer units so that the retroscan of one emissive interlayer unit does not excite unwanted emission from the remaining emissive interlayer unit. It is alternatively possible to match the half peak absorption bandwidth of the absorptive sub-layer to the half peak absorption bandwidth of the emissive interlayer unit from which emission is not sought during scanning. In this construction the absorptive sub-layer does not prevent two emissive interlayer units from being simultaneously excited to emit, but rather functions to intercept emission from one of the emissive interlayer units, thereby minimizing or eliminating detection during retroscanning. Although the invention is generally described below in terms of unitary emissive interlayer units with composite emissive interlayer unit constructions being described only in connection with certain preferred embodiments, it is to be understood that composite emissive interlayer unit constructions are compatible with all embodiments of the invention, unless otherwise indicated.

The basic features of the invention can be appreciated by considering the construction and use of a multicolor photographic element satisfying the following structure:

| Structure I |
|---|
| 3rd Emulsion Layer Unit |
| 2nd Interlayer Unit |
| 2nd Emulsion Layer Unit |
| 1st Interlayer Unit |
| 1st Emulsion Layer Unit |
| Photographic Support |

The first, second and third emulsion layer units are each chosen to record imagewise exposure in a different one of the blue, green and red portions of the spectrum. Each emulsion layer unit can contain a single silver halide emulsion layer or can contain a combination of silver halide emulsion layers for recording exposures within the same region of the spectrum. It is, for example, common practice to segregate emulsions of different imaging speed by coating them as separate layers within an emulsion layer unit. The emulsion layer units can be of any convenient conventional construction. In a specifically preferred form the emulsion layer units correspond to those found in conventional color reversal photographic elements lacking an incorporated dye-forming coupler—i.e., they contain negative-working silver halide emulsions, but do not contain any image dye or image dye precursor.

The first interlayer unit interposed between the first and second emulsion layer units is constructed to transmit electromagnetic radiation that the first emulsion layer unit is intended to record and to absorb or reflect after photographic processing scanning radiation within at least one wavelength region. Similarly, the second interlayer unit interposed between the second and third emulsion layer units is constructed to transmit electromagnetic radiation that the first and second emulsion layer units are intended to record and to absorb or reflect after photographic processing scanning radiation within at least one wavelength region. One or both of the interlayer units is an emissive interlayer that absorbs scanning electromagnetic radiation in one wavelength region and emits electromagnetic radiation in a longer wavelength region.

When the emulsion layer units intended to record minus blue (green or red) lack sufficient native blue sensitivity to require protection from blue light during imagewise exposure, six coating sequences of blue, green and red recording emulsion layer units are possible. Assigning the following descriptors:

IL1=first interlayer unit,
IL2=second interlayer unit,
B=blue recording emulsion layer unit,
G=green recording emulsion layer unit,
R=red recording emulsion layer unit, and
S=support, all of the following layer order sequences are contemplated: B/IL2/G/IL1/R/S, B/IL2/R/IL1/G/S, G/IL2/R/IL1/B/S, R/IL2/G/IL1/B/S, G/IL2/-B/IL1/R/S and R/IL2/B/IL1/G/S. Silver chloride and silver chlorobromide emulsions exhibit such negligibly low levels of native blue sensitivity that all conventional emulsions of these grain compositions can be employed without taking steps to protect the green or red recording emulsion layer units of these silver halide compositions from blue light exposure. Kofron et al U.S. Pat. No. 4,439,520 has demonstrated that adequate separation of blue and minus blue exposures can be achieved with tabular grain silver bromide or bromoiodide emulsions without protecting the minus blue recording layer units from blue light exposure.

The transmission and absorption or reflection characteristics required for the first and second interlayer units during imagewise exposure can now be appreciated by considering the layer order sequences individually. Although imagewise exposure through the support of the photographic elements is in theory possible, the descriptions that follow are based on exposing radiation first striking the third emulsion layer unit, since opaque and antihalation layer containing supports preclude exposure through the support in most preferred photographic element constructions.

(LS-1)

B/IL2/G/IL1/R/S

In this layer sequence IL1 must be capable of transmitting red light and IL2 must be capable of transmitting green and red light during imagewise exposure. When G and R exhibit negligible native blue sensitivity, there is no requirement that IL1 or IL2 be capable of absorbing light of any wavelength during imagewise exposure. When G and R contain silver bromide or bromoiodide emulsions, it is preferred that at least IL2 and, most preferably, both IL1 and IL2 be capable of absorbing blue light during imagewise exposure.

(LS-2)

B/IL2/R/IL1/G/S

In this layer sequence IL1 must be capable of transmitting green light, otherwise the description above for LS-1 is fully applicable.

(LS-3)

G/IL2/R/IL1/B/S

In this layer sequence IL1 must be capable of transmitting blue light and IL2 must be capable of transmitting blue and red light during imagewise exposure. In this arrangement G exhibits negligible native blue sensitivity. When R exhibits negligible native blue sensitivity, there is no requirement that IL2 be capable of absorbing light of any wavelength during imagewise exposure. When R contains a silver bromide or bromoiodide emulsion, it is preferred that IL2 be capable of absorbing blue light during imagewise exposure.

(LS-4)

R/IL2/G/IL1/B/S

In this layer sequence the G and R silver halide selection criteria are reversed from those described for LS-3 to reflect the interchanged positions of these emulsion layer units and IL2 must transmit green and blue light, but otherwise the description above for LS-3 is fully applicable.

(LS-5)

G/IL2/B/IL1/R/S

In this layer sequence IL1 must be capable of transmitting red light and IL2 must be capable of transmitting blue and red light during imagewise exposure. In this arrangement G exhibits negligible native blue sensitivity. When R exhibits negligible native blue sensitivity, there is no requirement that IL1 be capable of absorbing light of any wavelength during imagewise exposure. When R contains a silver bromide or bromoiodide emulsion, it is preferred that IL1 be capable of absorbing blue light during imagewise exposure.

(LS-6)

R/IL2/B/IL1/G/S

In this layer sequence IL1 must be capable of transmitting green light and IL2 must be capable of transmitting blue and green light during imagewise exposure. In this arrangement R exhibits negligible native blue sensitivity. When G exhibits negligible native blue sensitivity, there is no requirement that IL1 be capable of absorbing light of any wavelength during imagewise exposure. When G contains a silver bromide or bromoiodide emulsion, it is preferred that IL1 be capable of absorbing blue light during imagewise exposure.

Following imagewise exposure the photographic element is photographically processed to develop silver halide in the first, second and third emulsion layer units to silver as a function of latent image formation in the emulsion grains. Following development residual silver halide is removed from the first, second and third emulsion layer units by any convenient conventional nonbleaching fixing technique. As previously discussed, if one or both of the interlayer units contains silver halide, this silver halide differs from that in the interlayer units to allow the interlayer unit silver halide to remain after silver halide in the emulsion layer units is solubilized during fixing.

At the conclusion of photographic processing the element contains three separate silver images, a silver image representing a blue exposure record, a silver image representing a green exposure record, and a silver image representing a red exposure record. All of the silver images are of essentially the same hue.

One of the significant features of this invention is the scanning approach used to obtain three differentiated blue, green and red image records. It has been discovered that two retroscans and a third overall scan that can be either a retroscan or a transmission scan, depending on the element support structure, can be selected to produce three different scan records from which the blue, green and red image records can be obtained.

The overall scan and one or both of the retroscans are conducted within spectral wavelength regions in which the developed silver absorbs light and the vehicle of the emulsion layer units and interlayer units (here used to mean all of the non-reflective components) are transmissive. Scanning radiation is intercepted by developed silver. One or both of the interlayer units absorb and emit light during the retroscans in areas where developed silver is not present. Optionally, one of the interlayer units can be a passive absorptive interlayer unit or a reflective interlayer unit. It is generally convenient to conduct each of the scans within an overall wavelength range of from 300 to 900 nm, which extends from the near ultraviolet through the visible portion of the spectrum and into the near infrared. Within this overall wavelength range the two retroscans scans noted above can be in the same or different wavelength regions, depending on the particular approach to scanning selected. To minimize light absorption and/or reflection during the overall scan, this scan is preferably conducted in a different wavelength region than the two retroscans. Although the overall 300 to 900 nm scanning bandwidth leaves ample latitude for broad band scanning wavelengths, it is generally preferred that each scan be conducted over bandwidths that can be easily established using commercially available filters. Laser scanning, of course, permits very narrow scanning bandwidths.

Beginning with the assumption that the support is transparent following photographic processing, the preferred scanning technique is to retroscan the third emulsion layer unit of Structure I from above (assuming the orientation shown above) using the absorption or reflection of the second interlayer unit to restrict reflected image information to just that contained in the third emulsion layer unit. Similarly, the first emulsion layer unit of Structure I is also retroscanned from beneath the support at a wavelength the first interlayer unit is capable of reflecting or absorbing to provide a record of the image in the first emulsion layer unit. The photographic element is then scanned through the support, the two interlayer units and all emulsion layer units.

When the support is reflective following photographic processing, the preferred scanning technique is to retroscan the third emulsion layer unit of Structure I from above (assuming the orientation shown above) using the absorption or reflection of the second interlayer unit to restrict reflected image information to just that contained in the third emulsion layer unit. In a second retroscan the combined image information in the second and third emulsion layer units is obtained using the absorption or reflection of the first interlayer unit. The image information of the second emulsion layer unit is later obtained mathematically by subtracting the third emulsion layer unit image information obtained in the first retroscan from the image information obtained in the second retroscan. The overall scan is also conducted from above Structure I and constitutes a third retroscan. In the third retroscan light penetrates both of the interlayer units and all of the emulsion layer units in areas containing no developed silver and is reflected from the support.

In a variation, it is possible to retroscan the second and third emulsion layer units from above as described even when the support is transparent following photographic processing. In this instance the overall scan is a transmission scan.

From the foregoing description the general features of the photographic elements of the invention are apparent. The description that follows has as its purpose to illustrate certain specific embodiments.

Structure II constitutes a preferred embodiment of a photographic element satisfying the requirements of the invention.

| Structure II |
|---|
| Protective Overcoat |
| 3rd Emulsion Layer Unit (3ELU) |
| 2nd Emissive Interlayer Unit (EmIL2) |
| 2nd Emissive Sub-Layer (EmSL2) |
| 2nd Absorptive Sub-Layer (AbSL2) |
| 2nd Emulsion Layer Unit (2ELU) |
| 1st Emissive Interlayer Unit (EmIL1) |
| 1st Absorptive Sub-Layer (AbSL1) |
| 1st Emissive Sub-Layer (EmSL1) |
| 1st Emulsion Layer Unit (1ELU) |
| Antihalation Layer Unit |
| Transparent Support (TS) |

The transparent support, the antihalation layer unit, and the protective overcoat are conventional features of photographic elements and require no detailed description. The protective overcoat is typically a transparent layer containing a conventional photographic vehicle and a matting agent. Antistatic materials as well as lubricants or also often included. The antihalation layer unit can be alternatively coated on the backside of the support instead of being interposed between the support and the first emulsion layer unit. It is common practice to provide for coating convenience transparent photographic vehicle interlayers, not shown, between adjacent functional layers. It is also common practice to coat a separate antistatic layer on the backside of the support. Of these layers only the antihalation layer unit exhibits any significant light absorption, and that is limited to light absorption during imagewise exposure. Antihalation layer unit colorants are chosen to be removed or decolorized during photographic processing. A summary of these conventional features can be found in Research Disclosure, Item 308119, cited above, Sections VIII. Absorbing and scattering materials, IX. Vehicles and vehicle extenders, XI. coating aids, XII. Plasticizers and lubricants, XIII. Antistatic layers and XVII. Supports, the disclosure of which is here incorporated by reference.

Omitting the protective overcoat and antihalation layer, which are preferred, but not essential, Structure II can be written as follows:

3ELU/EmSL2/AbSL2/2ELU/AbSL1/EmSL1-/1ELU/TS.

In one preferred construction of Structure II each of the emulsion layer units contain silver bromoiodide (AgBrI) emulsions with inherent blue sensitivity. In this case it is preferred that 1ELU be a red recording layer unit (R), 2ELU be a green recording layer unit (G), and 3ELU be a blue recording layer unit (B). Each of EmSL1 and EmSL2 are blue light excited (absorbing) sub-layers (BSSL1 and BSSL2) that emit within a longer wavelength region than they absorb. Each of AbSL1 and AbSL2 are yellow sub-layers (YSL1 and YSL2)—that is, they are each selectively absorptive in the blue portion of the spectrum. In this form Structure II can be written as follows:

B/BXSL2/YSL2/G/YSL1/BXSL1/R/TS.

In use, Structure II is imagewise exposed from above the support. G is protected from exposure to blue light by YSL2 while R is protected from exposure to blue light by YSL1 and YSL2. After imagewise exposure Structure II is photographically developed to produce a silver image within each emulsion layer unit.

To recover three separate channels of image information from which the blue, green and red exposure images can be determined Structure II is retroscanned from above TS within the blue absorbing half peak bandwidth of BXSL2. Note that BXSL1 is not excited, since in retroscanning from above TS YSL1 and YSL2 each captures blue light before it can reach the BXSL1. In the areas of B in which no silver was formed during development blue light penetrates B and excites BXSL2 to emit. This emission is recorded by the retroscan detector. In the areas of B in which maximum silver density was formed by development little blue light penetrates B to excite BXSL2 and little or no emission is recorded by the retroscan detector. This retroscan provides a record of the silver image pattern in B—i.e., a blue exposure record.

A second retroscan is conducted from beneath TS. The second retroscan is essentially similar to the first retroscan, except that the developed silver in R is now the modulator. This retroscan excites BXSL1 to emit and provides a record of the silver image pattern in R. Note that YSL1 and YSL2 prevent unwanted excitation of BXSL2.

An overall transmission scan is conducted through the photographic element in a wavelength region that is outside the blue to avoid absorption by BXSL1, YSL1, BXSL2 or YSL2. The overall scan is conducted in a wavelength region in which developed silver in each of B, G and R absorb. The detector thus records the combined silver transmission densities of B, G and R. By subtracting the silver densities of B and R determined by the two retroscans from the transmission silver density, the silver density in G is determined, providing a record of exposure in the green region of the spectrum.

Structure II in the preferred form

B/BXSL2/YSL2/G/YSL1/BXSL1/R/TS.

described above offers several advantages over more general constructions. First, element construction is simplified, since BXSL1 can be identical to BXSL2 and YSL1 can be identical to YSL2. YSL1 and YSL2 not only prevent unwanted excitation of the BXSL1 or BXSL2 during intentional excitation of the other, they also perform the function during imagewise exposure of protecting G and R from unwanted blue exposure. In other words, YSL1 and YSL2 also perform the function of the conventional yellow interlayer that prevents blue contamination of minus blue (green and/or red) exposure records using silver bromide and, particularly, silver bromoiodide emulsions.

In a preferred alternative construction YSL1 is omitted to provide the structure:

B/BXSL2/YSL2/G/BXL1/R/TS.

where BXL1 is a blue excited unitary emissive interlayer that can be identical to BXSL2. In this construction YSL2 performs the functions performed by both YSL1 and YSL2 in the embodiment described above. Hence the structure is further simplified without sacrificing performance.

As demonstrated in the Examples below it is, in fact, possible to eliminate both YSL1 and YSL2 while still obtaining photographically useful records from each of B, G and R. In this form the structure becomes:

B/BXL2/G/BXL1/R/TS.

where BXL1 and BXL2 can be identical unitary blue excited emissive interlayers. The blue absorption by BXL1 or BXL2 when it is separately retroscanned as well as the developed silver in G allow sufficient attenuation of blue light in the emissive interlayer being scanned to reduce excitation of the remaining emissive interlayer. It should also be noticed that BXL2 and BXL1, both being blue absorbing, are capable of providing protection against unwanted blue exposure of G and R during imagewise exposure. Emissions by BXL1 and BXL2 during imagewise exposure are either negligibly small or nonexistent, since blue light intensity during imagewise exposure is much lower than the blue light intensities employed for retroscanning. However, even this remote possibility of image contamination can be eliminated by choosing emissive half peak bandwidths for BXL1 and BXL2 that are displaced from the absorption half peak bandwidths of the spectral sensitizing dyes in G and R.

In a still more general form of the invention the following structure is contemplated:

B/YFL/EmIL2/G/EmIL1/R/TS where YFL is a conventional yellow filter layer. As is well understood in the art these filter layers absorb blue light during imagewise exposure and are decolorized during processing. Preferably a conventional processing solution decolorizable dye dissolved or dispersed in a photographic vehicle is used to form YFL. EMIL1 and EMIL2 can take any convenient form, absorbing in any desired region of the spectrum. When optical isolation is desired to prevent simultaneously exciting emission in both EMIL1 and EMIL2, one or both can be a composite interlayer. Preferably EMIL1 is a composite interlayer, with the resulting structure being B/YFL/EmIL2/G/AbSL1/EmSL1/R/TS In another preferred form of the invention instead of employing YSL1 and/or YSL2 it is possible to substitute one or two neutral density sub-layers. These are preferred structures:

B/BXSL2/NSL2/G/NSL1/BXSL1/R/TS and

B/BXSL2/NSL2/G/BXSL1/R/TS where NSL1 and NSL2 are neutral density sub-layers.

In a specifically preferred form of the invention NSL1 and NSL2 exhibit only blue density or no density during imagewise exposure, but attain significant neutral density during photographic processing. As discussed above, a Lippmann emulsion that is developed to produce a uniform silver density is a preferred exemplary choice. The silver halide grains of the Lippmann emulsion are too small to reduce image sharpness by scattering light during imagewise exposure. By employing silver halides that contain significant iodide levels blue light absorption during imagewise exposure can be realized to protect G and R from unwanted blue exposures. When the grains of the Lippmann emulsion are uniformly converted to silver during development, an optical isolation barrier is provided that insures that each retroscan excites only one of BXSL1 and BXSL2 to emit light. During the overall scan NSL1 and NSL2 increase the transmission density, but since the increase in transmission density is a constant, it can be easily eliminated by subtraction in the same way that minimum density (fog) is eliminated in conventional black-and-white image scanning.

Although the structures above are shown to contain a blue absorbing emissive sub-layer, it is apparent that NSL1 and NSL2 can function without modification with equal advantage regardless of the spectral region in which the emissive sub-layers absorb. Thus, more generally contemplated preferred structures include:

B/EmSL2/NSL2/G/NSL1/EmSL1/R/TS and

B/EmSL2/NSL2/G/EmSL1/R/TS where EmSL1 and EmSL2 are similar emissive sub-layers.

In another preferred form of the invention unitary emissive interlayers are employed that differ in their spectral region of emission or absorption. This structure can be written as:

B/EmIL2/G/EmIL1/R/TS.

If EMIL1 and EMIL2 are both excited to emit during each retroscan, this poses no difficulty in obtaining separate records, provided each emits in a distinguishably different spectral region. For example, if EMIL1 and EMIL2 are both excited to emit by retroscanning with blue light, this poses no difficulty in obtaining the separate exposure records of B and R when EMIL2 emits in the blue and/or green and EMIL1 emits in the red. The advantage of this embodiment is that two unitary emissive interlayer units can be employed without contamination of the separate retroscan records.

When silver halide emulsions are employed for imaging that contain significant chloride ion concentrations, such as those containing greater than 50 mole percent chloride, based on total silver (e.g., silver chloride, silver chloroiodide or silver chlorobromide), the silver halides do not possess sufficient native blue sensitivity to require protection from blue light when employed for recording minus blue (green and/or red) exposures. Silver bromide emulsions have blue sensitivities intermediate those of silver bromoiodide and high chloride emulsions. They therefore benefit by protection from blue light exposures when sensitized to record minus blue exposures, but can be used without protection from unwanted blue light exposures when minus blue sensitized. When protection of minus blue recording layer units from blue light exposure is not required, the red, green and blue emulsion layer units can be arranged in any desired coating sequence and absorptive sub-layers are not required to minimize blue exposure of minus blue recording emulsion layer units.

Absorptive sub-layers can still be used to advantage, however, to eliminate halation. The following structure is specifically contemplated:

3AgCl/EmSL2/AbSL2/2AgCl/AbSL1/EmSL1-/1AgCl/TS where 1AgCl, 2AgCl and 3AgCl are silver chloride emulsion layer units that record exposures to different ones of the blue, green and red portions of the visible spectrum. When AbSL2 is chosen to absorb light of the same wavelength 3AgCl is intended to record, reflection of light in this wavelength region from the transparent support that would tend to blur image definition is reduced or eliminated. Similarly, when AbSL1 is chosen to absorb light of the same wavelength 2AgCl is intended to record, reflection of light in this wavelength region from the transparent support that would tend to blur image definition is reduced or eliminated.

Although the description above is directed specifically to silver chloride emulsions, it is applicable to emulsion layer units of all halide compositions. For example, the following constitutes a preferred structure:

B/EmSL2/YSL/G/MSL/EmSL1/R/TS where B, G and R are blue, green and red recording silver bromoiodide emulsion layer units, but could be of any silver halide composition, YSL is a yellow (blue absorbing) sub-layer, MSL is magenta (green absorbing) sub-layer, and TS is a transparent support. The yellow and magenta sub-layers are capable of performing the function of an antihalation layer in improving image sharpness.

In Structure II and the variant preferred structures described above the support is in all instances transparent following photographic processing, allowing one retroscan and one transmission scan to be conducted through the support. When the support is not penetrable by scanning beams, then all scans must be retroscans from above the support and modifications are required. Structure III constitutes a preferred photographic element having a reflective support:

| Structure III |
|---|
| Protective Overcoat |
| 3rd Emulsion Layer Unit (3ELU) |
| 2nd Emissive Interlayer Unit (EmIL2) |
| 2nd Emissive Sub-Layer (EmSL2) |
| 2nd Absorptive Sub-Layer (AbSL2) |

-continued

| Structure III |
|---|
| 2nd Emulsion Layer Unit (2ELU) |
| 1st Emissive Interlayer Unit (EmIL1) |
| 1st Emissive Sub-Layer (EmSL1) |
| 1st Absorptive Sub-Layer (AbSL1) |
| 1st Emulsion Layer Unit (1ELU) |
| Antihalation Layer Unit |
| Reflective Support (RS) |

In comparing Structures II and III the primary difference, apart from the substitution of RS for TS, is in the structure of EMIL1. Note that in Structure III AbSL1 is now positioned closer to the support than EmSL1. Further, the only function AbSL1 is called upon to perform is an antihalation function. Thus, when a separate antihalation layer unit is provided, as shown, EMIL1 is preferably a unitary emissive interlayer.

The retroscan from above the support that excites EmSL2 can be identically performed on Structures II and III and requires no detailed redescription. A second retroscan from above the support to excite EmSL1 must pass through 3EMLU, EMIL2 (including EmSL1 and AbSL1) and 2EMLU to reach EMIL1. This requires choosing EmSL1 and EmSL2 so that their emissions are distinguishable. There are several alternatives available.

One approach that simplifies retroscanning is to choose emissive components for EmSL1 and EmSL2 that allow both to respond to the see retroscan, but within different response periods. For example, emission measured within a few microseconds following retroscan excitation can be provided entirely or principally by one of the emissive interlayers while emission measured after a millisecond following the same retroscan excitation can be provided entirely or principally by the remaining emissive interlayer. The advantage of this approach is that only one retroscan provides two records. Second, the wavelengths of emission and absorption by EmSL1 and EmSL2 can be chosen each independently of the other. Only the relative emission response times of the EmSL1 and EmSL2 are of interest. With some emissive component selections the longer duration emission response can initially overlap the shorter duration emission response. This is apparent by considering the equation:

$$\Sigma Em = I \times t$$

where $\Sigma Em$ is the total emission,

I is the intensity of emission, and t is the time period over which total emission occurs.

When EmSL1 and EmSL2 exhibit equal total emissions (i.e., exhibit similar emission efficiencies), the intensity of the shorter duration emission response within a few microseconds following excitation is much larger than the intensity of the longer duration emission response. This allows the combined response of EmSL1 and EmSL2 within the first few microseconds following excitation to be used as the approximate response of the shorter duration emission response interlayer. Alternately, by knowing the decay profile of the longer duration response emissive component and the emission response after a millisecond delay following excitation, it is possible to correct the emission measured after a few microseconds to remove the small component contributed by the longer duration response emissive component. AbSL2 in this form of the invention is chosen not to absorb in the spectral region of the retroscan.

Another approach to obtaining distinguishable records of emission from EmSL1 and EmSL2 from a single retroscan excitation is to employ emissive components in EmSL1 and EmSL2 that emit in different spectral wavelength regions. Using detectors that are specific to each spectral region two different channels of information can be obtained. AbSL2 in this form of the invention is chosen not to absorb in the spectral region of the retroscan.

When EmSL1 and EmSL2 absorb in different wavelength regions but emit in the same or overlapping wavelength regions, two successive retroscans from above the reflective support are employed to obtain two separate channels of information.

When EmSL1 and EmSL2 both absorb and emit in different wavelength regions, two retroscan wavelengths can be employed concurrently or successively to obtain two channels of information. When concurrent excitation of EmSL1 and EmSL2 occurs, two separate detectors are required.

The overall scan employed with a reflective support photographic element is similar to that employed with a transparent support. The only significant difference is that the overall scanning beam twice penetrates all the emulsion layer units and interlayers of the photographic element before detection. This increases the modulation of the overall scanning beam.

RS can be a conventional white photographic support. Alternatively, RS can be of any convenient hue or construction capable of reflecting light during the overall scan. In a variant form, it is specifically contemplated to replace the antihalation layer unit with an additional emissive interlayer unit. In this construction the overall scan provides a third emission signal.

When three retroscans are employed, the three scans can be conducted in any sequential or concurrent combination. For example, three separate light sources can be used to perform three separate scans concurrently. Alternatively, one light source can be used and filters can be used to supply each scan record selectively to the appropriate sensor. The advantages of this approach are that only one light source is required and the consolidation of all scans into one addressing operation simplifies the task of spatial registration that forms an integral part of correlating pixel-by-pixel information from different scans. When three retroscans are employed, the support can be either transmissive or reflective. In performing the overall retroscan on an element with a transparent support the support is placed in optical contact with a reflective backing material. In all forms of the invention, when the scans are conducted sequentially, it is possible to use the same sensor for successive scans.

Conventional scanning techniques satisfying the requirements described above can be employed, including point-by-point, line-by-line and area scanning, and require no detailed description. A simple technique for scanning is to scan the photographically processed element point-by-point along a series of laterally offset parallel scan paths. The intensity of light received from or passing through the photographic element at a scanning point is noted by a sensor which converts radiation received into an electrical signal. The electrical signal is passed through an analogue to digital converter and sent to memory in a digital computer together with locant information required for pixel location within the image. Signal comparisons and mathematical operations to resolve scan records that represent combinations of two or three different images can be undertaken by routine procedures once the information obtained by scanning has been placed in the computer.

Once the image records corresponding to the latent images have been obtained, the original image or selected variations of the original image can be reproduced at will. The simplest approach is to use lasers to expose pixel-by-pixel a conventional color paper. Simpson et al U.S. Pat. No. 4,619,892 discloses differentially infrared sensitized color print materials particularly adapted for exposure with near infrared lasers. Instead of producing a viewable hard copy of the original image the image information can instead be fed to a video display terminal for viewing or fed to a storage medium (e.g., an optical disk) for archival storage and later viewing.

One of the challenges encountered in producing images from information extracted by scanning is that the number of pixels of information available for viewing is only a fraction of that available from a comparable classical photographic print. It is therefore even more important in scan imaging to maximize the quality of the image information available from each pixel. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. Although the invention is described in terms of point-by-point scanning, it is appreciated that conventional approaches to improving image quality are contemplated. Illustrative systems of scan signal manipulation, including techniques for maximizing the quality of image records, are disclosed by Bayer U.S. Pat. No. 4,553,165, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. No. 4,694,342, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. No. 4,920,501, Kimoto et al U.S. Pat. No. 4,929,979, Klees U.S. Pat. No. 4,962,542, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Sullivan et al U.S. Pat. No. 5,070,413, Bowers et al U.S. Pat. No. 5,107,346, Telle U.S. Pat. No. 5,105,266, MacDonald et al U.S. Pat. No. 5,105,469, and Kwon et al U.S. Pat. No. 5,081,692, the disclosures of which are here incorporated by reference.

The multicolor photographic elements and their photographic processing, apart from the specific required features described above, can take any convenient conventional form. A summary of conventional photographic element features as well as their exposure and processing is contained in Research Disclosure, Item 308119, cited above, and a summary of tabular grain emulsion and photographic element features and their processing is contained in Research Disclosure, Vol. 225, December 1983, Item 22534, the disclosures of which are here incorporated by reference.

Although the interlayer units have been described in terms of being absorptive or reflective in selected wavelength regions and ideally specularly transmissive in other wavelength regions, it is appreciated that interlayer units capable of performing their intended light reflection or absorption function (either with or without emission) in practice are rarely ideally specularly transmissive during imagewise exposure of underlying emulsion layer units. Overall, it is contemplated that each emulsion layer unit will receive at least 25 percent, preferably at least 50 percent and optimally at least 75 percent of the light it is intended to record. This allows ample tolerance for constructing interlayer units capable of functioning as described.

EXAMPLES

The invention can be better appreciated by reference to the following specific examples. Example films were prepared as described below. Coating laydowns, set out in brackets ([]) are reported in terms of grams per square meter ($g/m^2$), except as specifically noted. Silver halide coverages are reported in terms of silver.

EXAMPLE 1

Preparation of Lumogen Yellow TM dispersion:

The yellow organic solid particle dye EC-26 was obtained from BASF Corporation of Holland, Mich., under the trademark Lumogen Yellow TM. The absorption and emission spectra for this dye have been reported in the literature (see Kristainpoller and Dutton, Applied Optics, 3(2), 287 (1964)). The dye emits predominantly in the green region of the spectrum (500–600 nm) when excited with ultraviolet or blue light (wavelengths shorter than 500 nm). The propensity of this pigment to scatter light was greatly reduced by ball-milling to reduce the particle size. To 76.7 g of distilled water was added 15.0 g EC-26 and 8.3 g of Triton X-200 TM, an octylphenoxy polyethoxy ethanol surfactant. This dispersion was added to a 16 fluid ounce (473 ml) glass jar along with 250 ml of 1.0 mm zirconium beads. The contents were milled for one week using a SWECO TM vibratory mill. The particle size was reduced from a range of 0.5–1.0 μm diameter to all particles being smaller than 0.3 μm. This dispersion was added directly to gelatin for the subsequent film coatings.

A color recording film was prepared by coating the following layers in order on a cellulose triacetate film base having a process removable antihalation layer on the side opposite the coated layers. All emulsions were sulfur and gold chemically sensitized and spectrally sensitized to the appropriate region of the spectrum. The silver halide emulsions were of the tabular grain type and were silver bromoiodide having between 1 and 6 mole % iodide.

Layer 1: Red recording layer

Gelatin, [1.61];
Red-sensitized emulsion [1.34] (ECD 2.9 μm, thickness, t, 0.13 μm);

Layer 2: Fluorescent interlayer

Gelatin [1.08];
EC-26 [0.32].

Layer 3: Gelatin interlayer

Gelatin [2.38].

Layer 4: Green recording layer

Gelatin [1.61];
Green-sensitized emulsion [1.34] (ECD 2.2 μm, t 0.12 μm).

Layer 5: Fluorescent interlayer

Gelatin [1.08];
EC-26 [0.32].

Layer 6: Yellow Filter Layer

Gelatin [1.08 ];
4-(p-(butylsulfonamido)-phenyl)-3-cyano-5-(2-furylmethine)-2-oxo-2,5-dihydro-furan [0.32 ].

Layer 7: Blue Recording Layer

Gelatin [1.61];
Blue-sensitive emulsion [1.34](ECD 3.2 μm, t 0.14 μm).

Layer 8: Supercoat

Gelatin [1.08].
Bis(vinylsulfonylmethyl)ether [0.008].

Also present in the blue and green recording layers was 4-hydroxy-6-methyl-1,3,3A,7-tetraazindene, sodium salt, at 1.25 grams per mole of silver. Surfactants used to aid the coating operation are not listed in these examples.

Samples of the coated film were provided a neutral exposure in a photographic sensitometer using a Daylight balanced light source having a color temperature of 5500° K. and a graduated neutral density step wedge having an increment of 0.15 log exposure units per step. In addition, spectral separation step exposures were made by passing the exposing light through a Kodak Wratten TM 98 (blue, transmitting light in the 400–500 nm wavelength range), 99 (green, transmitting light in the 500–600 nm wavelength range), or 29 (red, transmitting light at wavelengths longer than 600 nm).

The exposed film samples were chemically processed with a black-and-white developer according to the following procedure:

1. Develop in Kodak Rapid X-Ray TM developer for 6 minutes at 22° C.
2. Kodak Indicator TM stop bath for 1 minute.
3. Kodak Rapid TM fixer for 3 minutes.
4. Wash for 5 minutes.
5. Dry film The processed film contained a step-wise distribution of developed silver and a uniform distribution of fluorescent (solid particle) dye. The blue and red separation exposures were used to obtain the densitometry necessary to produce calibration curves relating fluorescence reflection density to transmission density. The transmission density was measured in a spectral region where the fluorescent dye was not absorbing (600 nm). The fluorescence reflection densitometry was performed by illuminating the film at an angle of 45° to the normal. The excitation of fluorescence was at a wavelength of 460 nm with a spectral bandwidth of 10 nm. The detection of luminesced radiation was performed by a photosensor positioned along the same normal to the film. The detector was spectrally filtered by Wratten TM 74 and 60 filters so as to detect only the green emission from 500–580 nm with the peak response at 540 nm.

Fluorescence reflection densities measured through the front surface of the coating (FRF) and the coating base (BRF), and transmission densities (RTR) were measured for each type and level of exposure. For each type of measurement (FRF, BRF, and RTR) a minimum density (FRFmin, BRFmin, and RTRmin, respectively) was measured for a photographically processed film sample that had not been exposed to light. New film responses (FRF', BRF', and RTR') were determined for all exposures by subtracting the minimum density from the corresponding measured responses $$FRF' = FRF - FRF\text{min}$$

$$BRF' = BRF - BRF\text{min}$$

$$RTR' = RTR - RTR\text{min}$$

Tables III through VI tabulate values of FRF', BRF', and RTR' for the neutral, blue, green, and red exposures, respectively.

TABLE III

| | Neutral Exposure | | |
|---|---|---|---|
| Relative Log Exposure | BRF' | RTR' | FRF' |
| 0.00 | 0.00 | 0.00 | 0.00 |
| 0.15 | 0.02 | 0.03 | 0.02 |
| 0.30 | 0.06 | 0.06 | 0.05 |
| 0.45 | 0.14 | 0.13 | 0.11 |
| 0.60 | 0.25 | 0.26 | 0.22 |
| 0.75 | 0.42 | 0.47 | 0.36 |
| 0.90 | 0.61 | 0.78 | 0.58 |
| 1.05 | 0.79 | 1.14 | 0.82 |
| 1.20 | 0.93 | 1.48 | 1.04 |
| 1.35 | 1.04 | 1.78 | 1.23 |
| 1.50 | 1.13 | 2.00 | 1.35 |
| 1.65 | 1.20 | 2.17 | 1.45 |
| 1.80 | 1.27 | 2.30 | 1.50 |
| 1.95 | 1.32 | 2.39 | 1.54 |
| 2.10 | 1.34 | 2.45 | 1.56 |
| 2.25 | 1.36 | 2.49 | 1.57 |

TABLE IV

| | Blue Exposure | | |
|---|---|---|---|
| Relative Log Exposure | BRF' | RTR' | FRF' |
| 0.00 | 0.00 | 0.00 | 0.00 |
| 0.15 | 0.00 | 0.01 | 0.02 |
| 0.30 | 0.00 | 0.02 | 0.04 |
| 0.45 | 0.01 | 0.05 | 0.10 |
| 0.60 | 0.02 | 0.09 | 0.19 |
| 0.75 | 0.03 | 0.16 | 0.33 |
| 0.90 | 0.04 | 0.28 | 0.56 |
| 1.05 | 0.05 | 0.41 | 0.80 |
| 1.20 | 0.05 | 0.54 | 1.05 |
| 1.35 | 0.05 | 0.64 | 1.23 |
| 1.50 | 0.05 | 0.70 | 1.35 |
| 1.65 | 0.05 | 0.74 | 1.42 |
| 1.80 | 0.05 | 0.77 | 1.48 |
| 1.95 | 0.05 | 0.78 | 1.50 |
| 2.10 | 0.05 | 0.79 | 1.52 |
| 2.25 | 0.05 | 0.80 | 1.54 |

TABLE V

| | Green Exposure | | |
|---|---|---|---|
| Relative Log Exposure | BRF' | RTR' | FRF' |
| 0.00 | 0.00 | 0.01 | 0.00 |
| 0.15 | 0.01 | 0.02 | 0.01 |
| 0.30 | 0.02 | 0.04 | 0.03 |
| 0.45 | 0.05 | 0.08 | 0.06 |
| 0.60 | 0.09 | 0.15 | 0.10 |

TABLE V-continued

| Relative Log Exposure | Green Exposure BRF' | RTR' | FRF' |
|---|---|---|---|
| 0.75 | 0.12 | 0.26 | 0.13 |
| 0.90 | 0.14 | 0.39 | 0.15 |
| 1.05 | 0.16 | 0.54 | 0.16 |
| 1.20 | 0.18 | 0.68 | 0.16 |
| 1.35 | 0.22 | 0.81 | 0.17 |
| 1.50 | 0.29 | 0.93 | 0.17 |
| 1.65 | 0.41 | 1.05 | 0.17 |
| 1.80 | 0.56 | 1.18 | 0.17 |
| 1.95 | 0.72 | 1.30 | 0.16 |
| 2.10 | 0.86 | 1.41 | 0.16 |
| 2.25 | 0.99 | 1.50 | 0.17 |

TABLE VI

| Relative Log Exposure | Red Exposure BRF' | RTR' | FRF' |
|---|---|---|---|
| 0.00 | 0.00 | 0.00 | 0.00 |
| 0.15 | 0.02 | 0.01 | 0.00 |
| 0.30 | 0.05 | 0.03 | 0.00 |
| 0.45 | 0.11 | 0.07 | 0.01 |
| 0.60 | 0.22 | 0.13 | 0.02 |
| 0.75 | 0.39 | 0.22 | 0.03 |
| 0.90 | 0.58 | 0.34 | 0.03 |
| 1.05 | 0.77 | 0.47 | 0.03 |
| 1.20 | 0.94 | 0.58 | 0.03 |
| 1.35 | 1.07 | 0.67 | 0.03 |
| 1.50 | 1.16 | 0.72 | 0.03 |
| 1.65 | 1.23 | 0.76 | 0.03 |
| 1.80 | 1.28 | 0.79 | 0.03 |
| 1.95 | 1.31 | 0.81 | 0.03 |
| 2.10 | 1.32 | 0.82 | 0.03 |
| 2.25 | 1.34 | 0.83 | 0.03 |

Inspection of Tables IV through VI indicates that the measured responses do not provide a direct measure of the individual recording layer unit images with the exception of BRF' and FRF' as measures of the red and blue recording layer unit images, respectively. The measured RTR' responses are affected by developed silver in other recording layer units due to the spectral neutrality of developed silver and the additivity of density. Mathematical manipulation of the measured responses was used to determine the individual images in the red, green, and blue recording layer units (R, G, and B, respectively) in terms of their corresponding transmission densities.

A plot of RTR' versus FRF' for the blue separation exposure was made. A best fit line satisfying the relationship $$RTR' = a1 \times FRF$$

was determined using standard methods of linear regression over the range of exposures where image formation occurred in the blue recording layer unit only. A value of 0.523 was found for a1. The response of the blue recording layer unit (B) was determined using the relationship $$B = a1 \times FRF.$$

A plot of RTR' versus BRF' for the red separation exposure was made. A best fit line satisfying the relationship $$RTR' = a2 \times BRF$$

was determined using standard methods of linear regression over the range of exposures where image formation occurred in the red recording layer unit only. A value of 0.624 was found for a2. The response of the red recording layer unit (R) was determined using the relationship $$R = a2 \times BRF.$$

The response of the green recording layer unit (G) was determined using the relationship $$G = RTR' - B - R$$

taking advantage of the spectral neutrality of the developed silver image in the three recording layer units and the additivity of transmission densities.

The independent recording layer unit responses (R, G, and B) determined for the neutral, blue, green, and red exposures determined using the relationships previously described are listed in Tables VII through X, respectively.

TABLE VII

| Relative Log Exposure | Neutral Exposure R | G | B |
|---|---|---|---|
| 0.00 | 0.00 | 0.00 | 0.00 |
| 0.15 | 0.01 | 0.01 | 0.01 |
| 0.30 | 0.04 | 0.00 | 0.03 |
| 0.45 | 0.09 | −0.01 | 0.06 |
| 0.60 | 0.16 | −0.01 | 0.12 |
| 0.75 | 0.26 | 0.02 | 0.19 |
| 0.90 | 0.38 | 0.10 | 0.30 |
| 1.05 | 0.49 | 0.22 | 0.43 |
| 1.20 | 0.58 | 0.36 | 0.54 |
| 1.35 | 0.65 | 0.49 | 0.64 |
| 1.50 | 0.71 | 0.59 | 0.71 |
| 1.65 | 0.75 | 0.66 | 0.76 |
| 1.80 | 0.79 | 0.72 | 0.79 |
| 1.95 | 0.82 | 0.76 | 0.81 |
| 2.10 | 0.84 | 0.80 | 0.82 |
| 2.25 | 0.85 | 0.82 | 0.82 |

TABLE VIII

| Relative Log Exposure | Blue Exposure R | G | B |
|---|---|---|---|
| 0.00 | 0.00 | 0.00 | 0.00 |
| 0.15 | 0.00 | 0.00 | 0.01 |
| 0.30 | 0.00 | 0.00 | 0.02 |
| 0.45 | 0.01 | −0.01 | 0.05 |
| 0.60 | 0.01 | −0.02 | 0.10 |
| 0.75 | 0.02 | −0.03 | 0.17 |
| 0.90 | 0.02 | −0.04 | 0.29 |
| 1.05 | 0.03 | −0.04 | 0.42 |
| 1.20 | 0.03 | −0.04 | 0.55 |
| 1.35 | 0.03 | −0.03 | 0.64 |
| 1.50 | 0.03 | −0.04 | 0.71 |
| 1.65 | 0.03 | −0.03 | 0.74 |
| 1.80 | 0.03 | −0.04 | 0.77 |
| 1.95 | 0.03 | −0.04 | 0.79 |
| 2.10 | 0.03 | −0.04 | 0.80 |
| 2.25 | 0.03 | −0.04 | 0.81 |

TABLE IX

| Relative Log Exposure | Green Exposure R | G | B |
|---|---|---|---|
| 0.00 | 0.00 | 0.01 | 0.00 |
| 0.15 | 0.01 | 0.01 | 0.01 |
| 0.30 | 0.01 | 0.01 | 0.02 |
| 0.45 | 0.03 | 0.02 | 0.03 |

TABLE IX-continued

| Relative Log Exposure | Green Exposure R | G | B |
|---|---|---|---|
| 0.60 | 0.06 | 0.04 | 0.05 |
| 0.75 | 0.07 | 0.12 | 0.07 |
| 0.90 | 0.09 | 0.22 | 0.08 |
| 1.05 | 0.10 | 0.36 | 0.08 |
| 1.20 | 0.11 | 0.48 | 0.08 |
| 1.35 | 0.14 | 0.58 | 0.09 |
| 1.50 | 0.18 | 0.66 | 0.09 |
| 1.65 | 0.26 | 0.71 | 0.09 |
| 1.80 | 0.35 | 0.74 | 0.09 |
| 1.95 | 0.45 | 0.77 | 0.08 |
| 2.10 | 0.54 | 0.79 | 0.08 |
| 2.25 | 0.62 | 0.79 | 0.09 |

TABLE X

| Relative Log Exposure | Red Exposure R | G | B |
|---|---|---|---|
| 0.00 | 0.00 | 0.00 | 0.00 |
| 0.15 | 0.01 | 0.00 | 0.00 |
| 0.30 | 0.03 | 0.00 | 0.00 |
| 0.45 | 0.07 | 0.00 | 0.01 |
| 0.60 | 0.14 | −0.02 | 0.01 |
| 0.75 | 0.24 | −0.04 | 0.02 |
| 0.90 | 0.36 | −0.04 | 0.02 |
| 1.05 | 0.48 | −0.03 | 0.02 |
| 1.20 | 0.59 | −0.02 | 0.02 |
| 1.35 | 0.67 | −0.01 | 0.02 |
| 1.50 | 0.72 | −0.02 | 0.02 |
| 1.65 | 0.77 | −0.02 | 0.02 |
| 1.80 | 0.80 | −0.02 | 0.02 |
| 1.95 | 0.82 | −0.02 | 0.02 |
| 2.10 | 0.82 | −0.02 | 0.02 |
| 2.25 | 0.84 | −0.02 | 0.02 |

The green exposure record of Table IX is plotted in FIG. 1.

Exposing a new piece of film in a conventional exposure device followed by photographic processing, scanning, and image data processing as previously described yields independent responses for the red, green, and blue recording layer units at each pixel in the photographic element. A plot of R, G, and B versus input exposure for the neutral exposure provides the necessary relationships to convert the independent recording layer responses determined to corresponding input exposures. Using the exposure values determined for each pixel of the film as input signals to a digital printing device produces a photographic reproduction of the original scene.

EXAMPLE 2

This example is the same as Example 1 with the exception that an optical isolation layer was coated between the first fluorescent interlayer and the green recording layer. The desirability of the optical isolation layer is apparent in FIG. 1, which plots the determined R, G, and B responses of the green separation exposure of Example 1 as a function of relative log exposure. A response is observed in both the blue and red recording layer units at low levels of green light exposure even though no development is expected in these recording layer units.

A very fine-grained Lippmann emulsion was used for the optical isolation layer of this invention. The silver bromide grains were monodisperse cubes with an edge length of 0.08 μm. The emulsion was not spectrally sensitized but was chemically fogged by adding 0.3 g of stannous chloride per silver mole and maintaining the emulsion at 40° C. for 30 minutes. Coatings of this emulsion were made at various coverages and processed in the same manner as for the full multilayer examples. It was determined that 0.54 g/m$^2$ provided an optical density of 1.0 upon development, sufficient to provide optical isolation during scanning.

Layer 3 of Example 1 was replaced with the following two layers coated in the following order beginning with the layer closest to the support.

Layer 3a: Optical Isolation Layer

Gelatin [1.30];
Chemically fogged Lippmann emulsion [0.54].

Layer 3b: Gelatin Interlayer

Gelatin [1.08].

Samples of the coated film were given neutral and separation exposures as previously described for Example 1 and black-and-white processed in the same manner. The processed film contained a step-wise distribution of developed silver in the image recording layers, a uniform distribution of developed silver in the optical isolation layer, and a uniform distribution of fluorescent dye. Fluorescence and transmission densitometry were performed on these samples in the same manner as previously described.

Tables XI through XIV tabulate values of FRF', BRF', and RTR' for the neutral, blue, green, and red exposures, respectively.

TABLE XI

| Relative Log Exposure | Neutral Exposure BRF' | RTR' | FRF' |
|---|---|---|---|
| 0.00 | 0.00 | 0.00 | 0.00 |
| 0.15 | 0.02 | 0.03 | 0.02 |
| 0.30 | 0.06 | 0.08 | 0.04 |
| 0.45 | 0.13 | 0.20 | 0.10 |
| 0.60 | 0.25 | 0.37 | 0.23 |
| 0.75 | 0.40 | 0.68 | 0.44 |
| 0.90 | 0.56 | 1.02 | 0.66 |
| 1.05 | 0.70 | 1.35 | 0.87 |
| 1.20 | 0.82 | 1.63 | 1.05 |
| 1.35 | 0.93 | 1.88 | 1.19 |
| 1.50 | 0.99 | 2.04 | 1.27 |
| 1.65 | 1.07 | 2.17 | 1.33 |
| 1.80 | 1.10 | 2.27 | 1.38 |
| 1.95 | 1.14 | 2.33 | 1.40 |
| 2.10 | 1.15 | 2.36 | 1.41 |
| 2.25 | 1.16 | 2.36 | 1.42 |

TABLE XII

| Relative Log Exposure | Blue Exposure BRF' | RTR' | FRF' |
|---|---|---|---|
| 0.00 | 0.00 | 0.00 | 0.00 |
| 0.15 | 0.00 | 0.01 | 0.02 |
| 0.30 | 0.00 | 0.02 | 0.03 |
| 0.45 | 0.00 | 0.03 | 0.07 |
| 0.60 | 0.00 | 0.07 | 0.16 |
| 0.75 | 0.00 | 0.15 | 0.30 |
| 0.90 | 0.00 | 0.25 | 0.52 |
| 1.05 | 0.00 | 0.38 | 0.77 |
| 1.20 | 0.00 | 0.49 | 0.98 |
| 1.35 | 0.00 | 0.58 | 1.17 |
| 1.50 | 0.00 | 0.64 | 1.27 |
| 1.65 | 0.00 | 0.67 | 1.35 |
| 1.80 | 0.00 | 0.68 | 1.40 |
| 1.95 | 0.00 | 0.70 | 1.42 |
| 2.10 | 0.00 | 0.71 | 1.43 |
| 2.25 | 0.00 | 0.71 | 1.43 |

TABLE XIII

| Relative Log Exposure | Green Exposure BRF' | RTR' | FRF' |
|---|---|---|---|
| 0.00 | 0.00 | 0.01 | 0.00 |
| 0.15 | 0.00 | 0.01 | 0.00 |
| 0.30 | 0.00 | 0.03 | 0.00 |
| 0.45 | 0.00 | 0.06 | 0.00 |
| 0.60 | 0.00 | 0.12 | 0.00 |
| 0.75 | 0.00 | 0.21 | 0.00 |
| 0.90 | 0.00 | 0.32 | 0.00 |
| 1.05 | 0.00 | 0.45 | 0.00 |
| 1.20 | 0.01 | 0.56 | 0.00 |
| 1.35 | 0.04 | 0.67 | 0.00 |
| 1.50 | 0.10 | 0.76 | 0.00 |
| 1.65 | 0.20 | 0.88 | 0.00 |
| 1.80 | 0.36 | 1.01 | 0.00 |
| 1.95 | 0.52 | 1.13 | 0.00 |
| 2.10 | 0.67 | 1.24 | 0.00 |
| 2.25 | 0.80 | 1.32 | 0.00 |

TABLE XIV

| Relative Log Exposure | Red Exposure BRF' | RTR' | FRF' |
|---|---|---|---|
| 0.00 | 0.00 | 0.00 | 0.00 |
| 0.15 | 0.02 | 0.01 | 0.00 |
| 0.30 | 0.04 | 0.02 | 0.00 |
| 0.45 | 0.08 | 0.04 | 0.00 |
| 0.60 | 0.16 | 0.08 | 0.00 |
| 0.75 | 0.29 | 0.16 | 0.00 |
| 0.90 | 0.46 | 0.26 | 0.00 |
| 1.05 | 0.65 | 0.38 | 0.00 |
| 1.20 | 0.83 | 0.48 | 0.00 |
| 1.35 | 0.97 | 0.57 | 0.00 |
| 1.50 | 1.07 | 0.63 | 0.00 |
| 1.65 | 1.15 | 0.68 | 0.00 |
| 1.80 | 1.20 | 0.71 | 0.00 |
| 1.95 | 1.22 | 0.72 | 0.00 |
| 2.10 | 1.24 | 0.74 | 0.00 |
| 2.25 | 1.26 | 0.74 | 0.00 |

Analysis of the measured responses as previously described resulted in the following values for the series of "a" constants:

a1=0.498 a2=0.598

The determined values for the R, G, and B responses using the relationships previously described are tabulated in Tables XV through XVIII for the neutral, blue, green, red exposures, respectively.

TABLE XV

| Relative Log Exposure | Neutral Exposure R | G | B |
|---|---|---|---|
| 0.00 | 0.00 | 0.00 | 0.00 |
| 0.15 | 0.01 | 0.01 | 0.01 |
| 0.30 | 0.04 | 0.02 | 0.02 |
| 0.45 | 0.08 | 0.07 | 0.05 |
| 0.60 | 0.15 | 0.11 | 0.11 |
| 0.75 | 0.24 | 0.22 | 0.22 |
| 0.90 | 0.33 | 0.36 | 0.33 |
| 1.05 | 0.42 | 0.50 | 0.43 |
| 1.20 | 0.49 | 0.62 | 0.52 |
| 1.35 | 0.56 | 0.73 | 0.59 |
| 1.50 | 0.59 | 0.82 | 0.63 |
| 1.65 | 0.64 | 0.87 | 0.66 |
| 1.80 | 0.66 | 0.93 | 0.69 |
| 1.95 | 0.68 | 0.95 | 0.70 |
| 2.10 | 0.69 | 0.97 | 0.70 |

TABLE XV-continued

| Relative Log Exposure | Neutral Exposure R | G | B |
|---|---|---|---|
| 2.25 | 0.69 | 0.96 | 0.71 |

TABLE XVI

| Relative Log Exposure | Blue Exposure R | G | B |
|---|---|---|---|
| 0.00 | 0.00 | 0.00 | 0.00 |
| 0.15 | 0.00 | 0.00 | 0.01 |
| 0.30 | 0.00 | 0.01 | 0.01 |
| 0.45 | 0.00 | 0.00 | 0.03 |
| 0.60 | 0.00 | −0.01 | 0.08 |
| 0.75 | 0.00 | 0.00 | 0.15 |
| 0.90 | 0.00 | −0.01 | 0.26 |
| 1.05 | 0.00 | 0.00 | 0.38 |
| 1.20 | 0.00 | 0.00 | 0.49 |
| 1.35 | 0.00 | 0.00 | 0.58 |
| 1.50 | 0.00 | 0.01 | 0.63 |
| 1.65 | 0.00 | 0.00 | 0.67 |
| 1.80 | 0.00 | −0.02 | 0.70 |
| 1.95 | 0.00 | −0.01 | 0.71 |
| 2.10 | 0.00 | 0.00 | 0.71 |
| 2.25 | 0.00 | 0.00 | 0.71 |

TABLE XVI

| Relative Log Exposure | Green Exposure R | G | B |
|---|---|---|---|
| 0.00 | 0.00 | 0.01 | 0.00 |
| 0.15 | 0.00 | 0.01 | 0.00 |
| 0.30 | 0.00 | 0.03 | 0.00 |
| 0.45 | 0.00 | 0.06 | 0.00 |
| 0.60 | 0.00 | 0.12 | 0.00 |
| 0.75 | 0.00 | 0.21 | 0.00 |
| 0.90 | 0.00 | 0.32 | 0.00 |
| 1.05 | 0.00 | 0.45 | 0.00 |
| 1.20 | 0.01 | 0.55 | 0.00 |
| 1.35 | 0.02 | 0.65 | 0.00 |
| 1.50 | 0.06 | 0.70 | 0.00 |
| 1.65 | 0.12 | 0.76 | 0.00 |
| 1.80 | 0.22 | 0.79 | 0.00 |
| 1.95 | 0.31 | 0.82 | 0.00 |
| 2.10 | 0.40 | 0.84 | 0.00 |
| 2.25 | 0.48 | 0.84 | 0.00 |

TABLE XVIII

| Relative Log Exposure | Red Exposure R | G | B |
|---|---|---|---|
| 0.00 | 0.00 | 0.00 | 0.00 |
| 0.15 | 0.01 | 0.00 | 0.00 |
| 0.30 | 0.02 | 0.00 | 0.00 |
| 0.45 | 0.05 | −0.01 | 0.00 |
| 0.60 | 0.10 | −0.02 | 0.00 |
| 0.75 | 0.17 | −0.01 | 0.00 |
| 0.90 | 0.28 | −0.02 | 0.00 |
| 1.05 | 0.39 | −0.01 | 0.00 |
| 1.20 | 0.50 | −0.02 | 0.00 |
| 1.35 | 0.58 | −0.01 | 0.00 |
| 1.50 | 0.64 | −0.01 | 0.00 |
| 1.65 | 0.69 | −0.01 | 0.00 |
| 1.80 | 0.72 | −0.01 | 0.00 |
| 1.95 | 0.73 | −0.01 | 0.00 |
| 2.10 | 0.74 | 0.00 | 0.00 |
| 2.25 | 0.75 | −0.01 | 0.00 |

Figure 2:
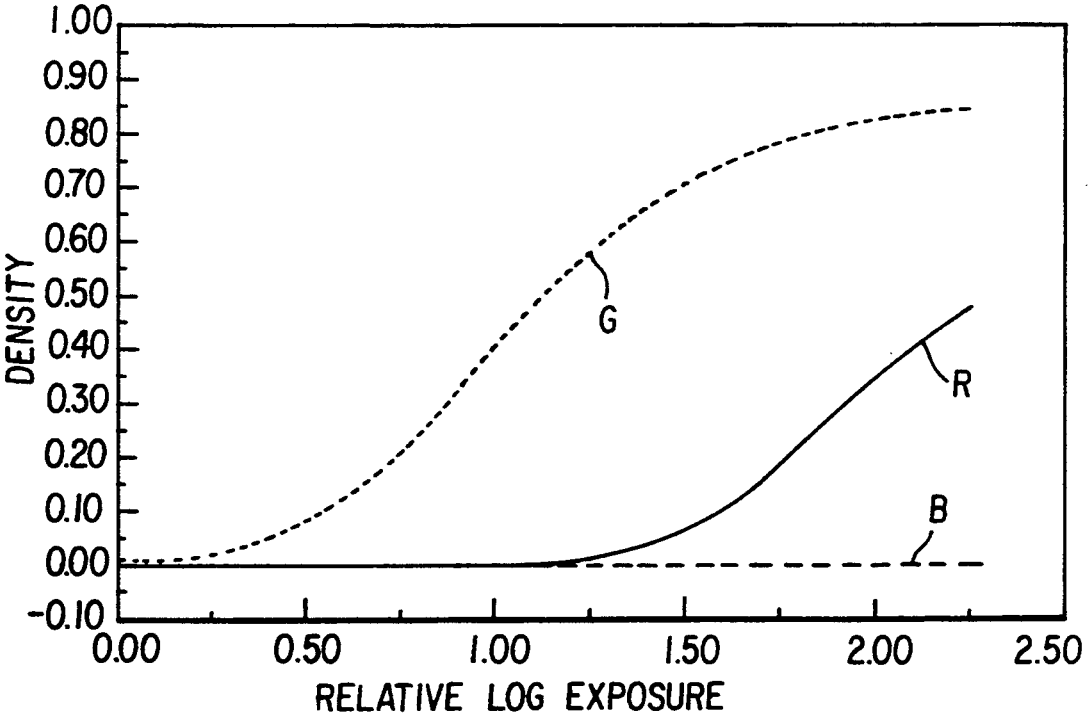

FIG. 2 shows the determined R, G, and B responses for the green separation exposure plotted as a function of relative log exposure. In this case there is no observed response in the blue record and the only response in the red record is that expected from the green light "punch through" exposure of the green recording layer unit. Comparison of this performance relative to that shown in FIG. 1 clearly demonstrates the benefit obtained by incorporation of the optical isolation layer.

EXAMPLE 3

A color recording film containing two fluorescent interlayers capable of emission in two different spectral regions was prepared by coating the following layers in order on a cellulose triacetate film base. The fluorescent dyes and oxidized developer scavenger were conventionally dispersed in the presence of coupler solvents such as tricresyl phosphate, dibutyl phthalate, and diethyl lauramide. The silver halide emulsions were of the tabular grain type except where otherwise stated, and were silver bromoiodide having between 1 and 6 mole % iodide.

Layer 1: Antihalation Underlayer

Gelatin, [2.5];
Process soluble neutral absorber dye, [0.08].

Layer 2: Red Recording Layer

Gelatin, [2.5];
Fast red-sensitized emulsion [0.30] (ECD 1.5 μm, thickness, t, 0.11 μm);
Mid red-sensitized emulsion [0.15] (ECD 0.72 μm, t 0.11 μm);
Slow red-sensitized emulsion [0.20] (ECD 0.28 μm, non-tabular);
Scavenging agent A [0.2].

Layer 3: Green-emitting Fluorescent Interlayer

Gelatin [1.5];
Fluorescent dye GF [0.15].

Layer 4: Green Recording Layer

Gelatin [1.5];
Fast green-sensitized emulsion [0.8] (ECD 1.5 μm, t 0.11 μm);
Mid green-sensitized emulsion [0.4] (ECD 0.7 μm, t 0.11 μm);
Slow green-sensitized emulsion [0.6] (ECD 0.28 μm, non-tabular);
Scavenging agent A [0.3].

Layer 5: Blue-emitting Fluorescent Interlayer

Gelatin [1.5];
Fluorescent dye EC-23 [0.05];
Process soluble yellow filter dyes [0.25].

Layer 6: Blue-sensitive Layer

Gelatin [1.5];
Fast blue-sensitive emulsion [0.20] (ECD 1.39 μm, 0.11 μm);
Mid blue-sensitive emulsion [0.08] (ECD 0.72 μm, t 0.08 μm);
Slow blue-sensitive emulsion [0.12] (ECD 0.32 μm, t 0.07 μm);
Scavenging agent A [0.1];
Bis(vinylsulfonyl)methane [0.19].

Layer 7: Supercoat

Gelatin [1.5].

Also present in every emulsion containing layer were 4-hydroxy-6-methyl-1,3,3A,7-tetraazindene, sodium salt, at 1.25 grams per mole of silver, and 2-octadecyl-5-sulphohydroquinone, sodium salt, at 2.4 grams per mole of silver. Surfactants used to aid the coating operation are not listed in these examples.

Scavenging agent A was of structure:

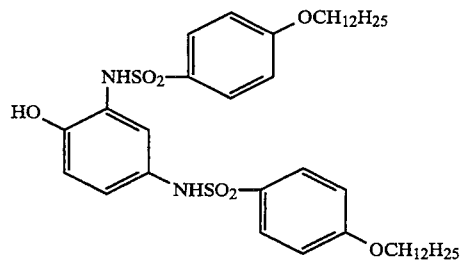

Fluorescent dye GF was Elbasol Fluorescent Brilliant Yellow R, supplied by Holliday Dyes and Chemicals Ltd. Fluorescent dye GF was excited by (absorbed) blue light.

A sample of the film was sensitometrically exposed to white light through a graduated neutral density step wedge (density increment 0.2 density units per step), and others were exposed through the graduated step wedge to light which had been filtered through Kodak Wratten TM 29, 74, and 98 filters, to give red, green, and blue exposures, respectively. The exposed film samples were developed for three and one quarter minutes in Kodak Flexicolor TM C41 developer at 38° C., soaked 30 seconds in an acetic acid stop bath, then fixed in ammonium thiosulfate fixer solution.

Status A red transmission densities (RTR) were measured for all photographically processed film samples. Additionally reflection densities were measured through the upper surface of the film samples first using blue light illumination (tungsten light source passed through a Kodak Wratten 47B TM filter) measuring Status A green density (GRF) and second using ultraviolet light illumination measuring Status A blue density (BRF). For each type of measurement (RTR, GRF, and BRF) a minimum density (RTRmin, GRFmin, and BRFmin, respectively) was measured for a photographically processed film sample that had not been exposed to light. New film responses (RTR', GRF', and BRF') were determined for all exposures by subtracting the minimum density from the corresponding measured responses $$RTR' = RTR - RTR\text{min}$$

$$GRF' = GRF - GRF\text{min}$$

$$BRF' = BRF - BRF\text{min}$$

The RTR', GRF', and BRF' responses for the neutral, blue, green, and red exposures are tabulated as a function of relative log exposure in Tables XIX through XXII, respectively.

TABLE XIX

| Relative Log Exposure | Neutral Exposure RTR' | GRF' | BRF' |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.00 | 0.00 |
| 0.8 | 0.01 | 0.00 | 0.00 |
| 1.0 | 0.02 | 0.02 | 0.01 |

TABLE XIX-continued

| Relative Log Exposure | Neutral Exposure RTR' | GRF' | BRF' |
|---|---|---|---|
| 1.2 | 0.03 | 0.04 | 0.04 |
| 1.4 | 0.06 | 0.11 | 0.06 |
| 1.6 | 0.12 | 0.23 | 0.08 |
| 1.8 | 0.23 | 0.37 | 0.10 |
| 2.0 | 0.35 | 0.54 | 0.13 |
| 2.2 | 0.49 | 0.73 | 0.17 |
| 2.4 | 0.63 | 0.94 | 0.22 |
| 2.6 | 0.78 | 1.16 | 0.28 |
| 2.8 | 0.90 | 1.36 | 0.37 |
| 3.0 | 1.03 | 1.58 | 0.44 |
| 3.2 | 1.16 | 1.77 | 0.54 |
| 3.4 | 1.30 | 1.92 | 0.62 |
| 3.6 | 1.51 | 2.06 | 0.70 |
| 3.8 | 1.71 | 2.18 | 0.79 |

TABLE XX

| Relative Log Exposure | Blue Exposure RTR' | GRF' | BRF' |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.00 | 0.00 |
| 0.8 | 0.00 | 0.00 | 0.00 |
| 1.0 | 0.00 | 0.00 | 0.00 |
| 1.2 | 0.00 | 0.00 | 0.00 |
| 1.4 | 0.01 | 0.01 | 0.01 |
| 1.6 | 0.02 | 0.03 | 0.03 |
| 1.8 | 0.03 | 0.05 | 0.07 |
| 2.0 | 0.04 | 0.09 | 0.12 |
| 2.2 | 0.06 | 0.13 | 0.16 |
| 2.4 | 0.08 | 0.18 | 0.21 |
| 2.6 | 0.13 | 0.26 | 0.27 |
| 2.8 | 0.25 | 0.45 | 0.33 |
| 3.0 | 0.35 | 0.64 | 0.40 |
| 3.2 | 0.48 | 0.86 | 0.48 |
| 3.4 | 0.57 | 1.09 | 0.56 |
| 3.6 | 0.71 | 1.30 | 0.64 |
| 3.8 | 0.87 | 1.54 | 0.70 |

TABLE XXI

| Relative Log Exposure | Green Exposure RTR' | GRF' | BRF' |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.00 | 0.01 |
| 0.8 | 0.01 | 0.01 | 0.01 |
| 1.0 | 0.01 | 0.04 | 0.01 |
| 1.2 | 0.03 | 0.08 | 0.01 |
| 1.4 | 0.07 | 0.17 | 0.01 |
| 1.6 | 0.12 | 0.30 | 0.02 |
| 1.8 | 0.20 | 0.43 | 0.02 |
| 2.0 | 0.29 | 0.61 | 0.02 |
| 2.2 | 0.39 | 0.80 | 0.02 |
| 2.4 | 0.47 | 1.00 | 0.02 |
| 2.6 | 0.56 | 1.14 | 0.02 |
| 2.8 | 0.66 | 1.31 | 0.02 |
| 3.0 | 0.78 | 1.46 | 0.02 |
| 3.2 | 0.93 | 1.64 | 0.02 |
| 3.4 | 1.09 | 1.82 | 0.02 |
| 3.6 | 1.27 | 1.93 | 0.02 |
| 3.8 | 1.44 | 2.00 | 0.02 |

TABLE XXII

| Relative Log Exposure | Red Exposure RTR' | GRF' | BRF' |
|---|---|---|---|
| 0.0 | 0.00 | 0.00 | 0.00 |

TABLE XXII-continued

| Relative Log Exposure | Red Exposure RTR' | GRF' | BRF' |
|---|---|---|---|
| 0.2 | 0.00 | 0.01 | 0.01 |
| 0.4 | 0.00 | 0.01 | 0.02 |
| 0.6 | 0.00 | 0.02 | 0.03 |
| 0.8 | 0.01 | 0.02 | 0.03 |
| 1.0 | 0.04 | 0.03 | 0.04 |
| 1.2 | 0.06 | 0.03 | 0.04 |
| 1.4 | 0.12 | 0.03 | 0.04 |
| 1.6 | 0.16 | 0.04 | 0.04 |
| 1.8 | 0.20 | 0.04 | 0.04 |
| 2.0 | 0.25 | 0.04 | 0.03 |
| 2.2 | 0.27 | 0.04 | 0.03 |
| 2.4 | 0.30 | 0.05 | 0.03 |
| 2.6 | 0.34 | 0.05 | 0.02 |
| 2.8 | 0.37 | 0.06 | 0.02 |
| 3.0 | 0.40 | 0.06 | 0.02 |
| 3.2 | 0.43 | 0.06 | 0.02 |
| 3.4 | 0.46 | 0.07 | 0.01 |
| 3.6 | 0.48 | 0.07 | 0.00 |
| 3.8 | 0.51 | 0.07 | 0.00 |

Inspection of Tables XX through XXII indicates that the measured responses do not provide a direct measure of the individual recording layer unit images with the exception of BRF' as a measure of the blue recording layer unit image. The measured RTR' and GRF' responses are affected by imagewise development in other recording layer units due to the spectral neutrality of developed silver and the additivity of density. Mathematical manipulation of the measured responses was used to determine the individual images in the red, green, and blue recording layer units (R, G, and B, respectively) in terms of their corresponding transmission densities.

A plot of RTR' versus BRF' for the blue separation exposure was made. A best fit line satisfying the relationship $$RTR' = a1 \times BRF'$$

was determined using standard methods of linear regression over the range of exposures where image formation occurred in the blue recording layer unit only. A value of 0.368 was found for a1. The response of the blue recording layer unit (B) was determined using the relationship $$B = a1 \times BRF'$$

A plot of GRF' versus BRF' was made for the same exposure. A best fit line satisfying the relationship $$GRF' = a2 \times BRF'$$

was determined using standard methods of linear regression over the range of exposures where image formation occurred in the blue recording layer unit only. A value of 0.896 was found for a2.

A plot of RTR' versus GRF' for the green separation exposure was made. A best fit line satisfying the relationship $$RTR' = a3 \times GRF'$$

was determined using standard methods of linear regression over the range of exposures where image formation occurred in the green recording layer unit only. A value of 0.494 was found for a3. The response of the green recording layer unit (G) was determined using the relationship $$G=a3\times[GRF-(a2\times BRF')].$$

The response of the red recording layer unit (R) was determined using the following relationship $$R=RTR'-B-G$$

taking advantage of the spectral neutrality of the developed silver image in the three recording layer units and the additivity of transmission densities.

The independent recording layer responses (R, G, and B) determined for the neutral, blue, green, and red exposures determined using the relationships previously described are listed in Tables XXIII through XXVI, respectively.

TABLE XXIII

| Relative Log Exposure | Neutral Exposure R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.00 | 0.00 |
| 0.8 | 0.01 | 0.00 | 0.00 |
| 1.0 | 0.01 | 0.01 | 0.00 |
| 1.2 | 0.01 | 0.00 | 0.02 |
| 1.4 | 0.01 | 0.03 | 0.03 |
| 1.6 | 0.01 | 0.08 | 0.03 |
| 1.8 | 0.05 | 0.14 | 0.04 |
| 2.0 | 0.09 | 0.21 | 0.06 |
| 2.2 | 0.13 | 0.29 | 0.07 |
| 2.4 | 0.17 | 0.37 | 0.09 |
| 2.6 | 0.21 | 0.45 | 0.12 |
| 2.8 | 0.24 | 0.51 | 0.16 |
| 3.0 | 0.26 | 0.59 | 0.19 |
| 3.2 | 0.30 | 0.64 | 0.23 |
| 3.4 | 0.36 | 0.67 | 0.26 |
| 3.6 | 0.51 | 0.71 | 0.30 |
| 3.8 | 0.65 | 0.73 | 0.33 |

TABLE XXIV

| Relative Log Exposure | Neutral Exposure R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.00 | 0.00 |
| 0.8 | 0.00 | 0.00 | 0.00 |
| 1.0 | 0.00 | 0.00 | 0.00 |
| 1.2 | 0.00 | 0.00 | 0.00 |
| 1.4 | 0.01 | 0.00 | 0.00 |
| 1.6 | 0.01 | 0.00 | 0.01 |
| 1.8 | 0.01 | −0.01 | 0.03 |
| 2.0 | 0.00 | −0.01 | 0.05 |
| 2.2 | 0.00 | −0.01 | 0.07 |
| 2.4 | 0.00 | 0.00 | 0.09 |
| 2.6 | 0.01 | 0.01 | 0.11 |
| 2.8 | 0.03 | 0.08 | 0.14 |
| 3.0 | 0.04 | 0.14 | 0.17 |
| 3.2 | 0.06 | 0.21 | 0.20 |
| 3.4 | 0.04 | 0.29 | 0.24 |
| 3.6 | 0.08 | 0.36 | 0.27 |
| 3.8 | 0.12 | 0.45 | 0.30 |

TABLE XXV

| Relative Log Exposure | Green Exposure R | G | B |
|---|---|---|---|
| 0.0 | 0.00 | 0.00 | 0.00 |

TABLE XXV-continued

| Relative Log Exposure | Green Exposure R | G | B |
|---|---|---|---|
| 0.2 | 0.00 | 0.00 | 0.00 |
| 0.4 | 0.00 | 0.00 | 0.00 |
| 0.6 | 0.00 | 0.00 | 0.00 |
| 0.8 | 0.01 | 0.00 | 0.00 |
| 1.0 | −0.01 | 0.02 | 0.00 |
| 1.2 | −0.01 | 0.04 | 0.00 |
| 1.4 | −0.01 | 0.08 | 0.00 |
| 1.6 | −0.03 | 0.14 | 0.01 |
| 1.8 | −0.01 | 0.20 | 0.01 |
| 2.0 | −0.01 | 0.29 | 0.01 |
| 2.2 | 0.00 | 0.39 | 0.01 |
| 2.4 | −0.02 | 0.49 | 0.01 |
| 2.6 | 0.00 | 0.55 | 0.01 |
| 2.8 | 0.01 | 0.64 | 0.01 |
| 3.0 | 0.06 | 0.71 | 0.01 |
| 3.2 | 0.12 | 0.80 | 0.01 |
| 3.4 | 0.19 | 0.89 | 0.01 |
| 3.6 | 0.32 | 0.94 | 0.01 |
| 3.8 | 0.45 | 0.98 | 0.01 |

TABLE XXVI

| Relative Log Exposure | Red Exposure R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.01 |
| 0.6 | −0.01 | 0.00 | 0.01 |
| 0.8 | 0.00 | 0.00 | 0.01 |
| 1.0 | 0.03 | 0.00 | 0.02 |
| 1.2 | 0.05 | 0.00 | 0.02 |
| 1.4 | 0.11 | 0.00 | 0.02 |
| 1.6 | 0.14 | 0.00 | 0.02 |
| 1.8 | 0.18 | 0.00 | 0.02 |
| 2.0 | 0.23 | 0.01 | 0.01 |
| 2.2 | 0.25 | 0.01 | 0.01 |
| 2.4 | 0.28 | 0.01 | 0.01 |
| 2.6 | 0.32 | 0.02 | 0.01 |
| 2.8 | 0.34 | 0.02 | 0.01 |
| 3.0 | 0.37 | 0.02 | 0.01 |
| 3.2 | 0.40 | 0.02 | 0.01 |
| 3.4 | 0.43 | 0.03 | 0.00 |
| 3.6 | 0.45 | 0.03 | 0.00 |
| 3.8 | 0.48 | 0.03 | 0.00 |

Exposing a new piece of film in a conventional exposure device followed by photographic processing, scanning, and image data processing as previously described yields independent responses for the red, green, and blue recording layer units at each pixel in the photographic element. A plot of R, B, and G versus input exposure for the neutral exposure provides the necessary relationships to convert the independent recording layer responses determined to corresponding input exposures. Using the exposure values determined for each pixel of the film as input signals to a digital printing device produces a photographic reproduction of the original scene.

EXAMPLE 4

Example 3 was repeated with the exception that the green reflection density was measured through the base of the photographically processed film.

A plot of RTR' versus GRF' for the red separation exposure was made. A best fit line satisfying the relationship $$RTR'=a2\times GRF$$

was determined using standard methods of linear regression over the range of exposures where image formation occurred in the red recording layer unit only. The response of the red recording layer unit was determined using the relationship $$R=a2\times GRF$$

The response of the green recording layer unit (G) was determined using the following relationship $$G=RTR'-B-R$$

taking advantage of the spectral neutrality of the developed silver image in the three recording layer units and the additivity of transmission densities. Photographic reproductions of recorded scenes are produced as described previously.

EXAMPLE 5

A color recording film containing one fluorescent interlayer and one scattering interlayer was prepared by coating the following layers in order on a cellulose triacetate film base. All emulsions were sulfur and gold chemically sensitized and spectrally sensitized to the appropriate part of the spectrum. Interlayer absorber and fluorescent dyes and oxidized developer scavenger were conventionally dispersed in the presence of coupler solvents such as tricresyl phosphate, dibutyl phthalate, and diethyl lauramide. The silver halide emulsions were of the tabular grain type except where otherwise stated, and were silver bromoiodide having between 1 and 6 mole % iodide.

Layer 1: Antihalation Underlayer

Gelatin, [2.5];
Antihalation dye C.I. Solvent Blue 35 [0.08].

Layer 2: Red Recording Layer

Gelatin, [2.5];
Fast red-sensitized emulsion [0.45] (ECD 3.0 μm, thickness, t, 0.12 μm);
Mid red-sensitized emulsion [0.20] (ECD 1.5 μm, t 0.11 μm);
Slow red-sensitized emulsion [0.45] (ECD 0.72 μm, t 0.11 μm);
Scavenging agent A [0.3].

Layer 3: Scattering Interlayer

Gelatin [2.7];
Ropaque HP-91 TM [2.0] (a latex of acrylic/styrene hollow polymeric beads, mean diameter approximately 1.0 μm, supplied by Rohm and Haas Co.).

Layer 4: Green-absorbing Layer

Gelatin [1.0];
Sudan Red 7B absorber dye [0.06].

Layer 5: Green Recording Layer

Gelatin [2.0];
Fast green-sensitized emulsion [1.0] (ECD 2.3 μm, t 0.12 μm);
Mid green-sensitized emulsion [0.4] (ECD 1.5 μm, t 0.11 μm);
Slow green-sensitized emulsion [0.6] (ECD 0.7 μm, t 0.11 μm);
Scavenging agent A [0.3].

Layer 6: Green-emitting Fluorescent Interlayer

Gelatin [1.8 ];
Fluorescent dye GF [0.15 ];
Process soluble yellow filter dyes [0.2].

Layer 7: Blue-sensitive Layer

Gelatin [1.5 ];
Fast blue-sensitive emulsion [0.20] (ECD 1.0 μm, non-tabular);
Mid blue-sensitive emulsion [0.10] (ECD 1.39 μm, t 0.11 μm);
Slow blue-sensitive emulsion [0.08] (ECD 0.72 μm, t 0.08 μm);
Slow blue-sensitive emulsion [0.12] (ECD 0.32 μm, t 0.07 μm);
Scavenging agent A [0.1];
Bis(vinylsulfonyl)methane [0.22].

Layer 7: Supercoat

Gelatin [1.5 ].

Also present in every emulsion containing layer were 4-hydroxy-6-methyl-1,3,3A,7-tetraazindene, sodium salt, at 1.25 grams per mole of silver, and 2-octadecyl-5-sulphohydroquinone, sodium salt, at 2.4 grams per mole of silver. Surfactants used to aid the coating operation are not listed in these examples.

A sample of the film was sensitometrically exposed to white light through a graduated density step wedge (density increment 0.2 density units per step), and others were exposed through the graduated step wedge to light which had been filtered through Kodak Wratten TM 29, 74, and 98 filters, to give red, green, and blue exposures, respectively. The exposed film samples were developed for three minutes in the following developer solution at 25° C.

| Component | Concentration (g/l) |
|---|---|
| Phenidone TM | 0.3 |
| $Na_2CO_3$ | 22.0 |
| $NaHCO_3$ | 8.0 |
| $Na_2SO_3$ | 2.0 |
| NaBr | 0.5 |
| Cysteine | 0.05 |

pH adjusted to 10.0 with dilute sulfuric acid. The samples were then placed for 30 seconds in an acetic acid stop bath, fixed for two minutes in Kodak A3000 Fixer TM solution (diluted one part fixer with three parts of water), washed in running water, soaked for 30 seconds in the following solution:

| Component | Concentration (g/l) |
|---|---|
| $Na_2CO_3$ | 25 |
| $NaHCO_3$ | 6 |

and washed for one minute in running water. The carbonate bath improved the fluorescence intensity from the interlayer.

Status A red transmission density (RTR) was measured for all photographically processed film samples. Additionally, Status A red and green reflection densities (RRF and GRF, respectively) were measured through the upper surface of the film samples illuminated with magenta light. For each type of measurement (RTR, RRF, and GRF) a minimum density (RTRmin, RRFmin, and GRFmin, respectively) was measured for a photographically processed film sample that had not been exposed to light. New film responses (RTR', RRF', and GRF') were determined for all exposures by subtracting the minimum density from the corresponding measured responses $$RTR' = RTR - RTR\text{min}$$

$$RRF = RRF - RRF\text{min}$$

$$GRF = GRF - GRF\text{min}$$

The RTR', RRF', and GRF' responses for the neutral, blue, green, and red exposures are tabulated as a function of relative log exposure in Tables XXVII through XXX, respectively.

TABLE XXVII

| Relative Log Exposure | Neutral Exposure RTR' | RRF' | GRF' |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.01 | 0.00 | 0.00 |
| 0.8 | 0.02 | 0.00 | 0.00 |
| 1.0 | 0.03 | 0.01 | 0.00 |
| 1.2 | 0.06 | 0.05 | 0.01 |
| 1.4 | 0.10 | 0.08 | 0.01 |
| 1.6 | 0.12 | 0.11 | 0.02 |
| 1.8 | 0.14 | 0.15 | 0.03 |
| 2.0 | 0.18 | 0.17 | 0.03 |
| 2.2 | 0.21 | 0.20 | 0.04 |
| 2.4 | 0.24 | 0.24 | 0.05 |
| 2.6 | 0.26 | 0.28 | 0.06 |
| 2.8 | 0.28 | 0.31 | 0.06 |
| 3.0 | 0.30 | 0.35 | 0.07 |
| 3.2 | 0.32 | 0.38 | 0.08 |
| 3.4 | 0.34 | 0.40 | 0.09 |
| 3.6 | 0.36 | 0.42 | 0.10 |
| 3.8 | 0.38 | 0.44 | 0.11 |
| 4.0 | 0.40 | 0.46 | 0.12 |

TABLE XXVIII

| Relative Log Exposure | Blue Exposure RTR' | RRF' | GRF' |
|---|---|---|---|
| 0.0 | 0.00 | 0.00 | 0.00 |
| 0.2 | 0.00 | 0.01 | 0.01 |
| 0.4 | 0.01 | 0.00 | 0.00 |
| 0.6 | 0.01 | 0.00 | 0.00 |
| 0.8 | 0.01 | 0.00 | 0.00 |
| 1.0 | 0.01 | 0.01 | 0.01 |
| 1.2 | 0.02 | 0.02 | 0.02 |
| 1.4 | 0.03 | 0.03 | 0.03 |
| 1.6 | 0.04 | 0.05 | 0.04 |
| 1.8 | 0.05 | 0.07 | 0.06 |
| 2.0 | 0.06 | 0.11 | 0.07 |
| 2.2 | 0.08 | 0.13 | 0.08 |
| 2.4 | 0.10 | 0.15 | 0.09 |
| 2.6 | 0.12 | 0.17 | 0.10 |
| 2.8 | 0.14 | 0.19 | 0.11 |
| 3.0 | 0.16 | 0.21 | 0.12 |
| 3.2 | 0.19 | 0.25 | 0.14 |
| 3.4 | 0.22 | 0.27 | 0.15 |
| 3.6 | 0.23 | 0.29 | 0.18 |
| 3.8 | 0.25 | 0.33 | 0.21 |
| 4.0 | 0.27 | 0.37 | 0.24 |

TABLE XXIX

| Relative Log Exposure | Green Exposure RTR' | RRF' | GRF' |
|---|---|---|---|
| 0.0 | 0.00 | 0.00 | 0.00 |
| 0.2 | 0.00 | 0.01 | 0.00 |
| 0.4 | 0.00 | 0.01 | 0.00 |
| 0.6 | 0.00 | 0.03 | 0.00 |
| 0.8 | 0.02 | 0.04 | 0.01 |
| 1.0 | 0.04 | 0.08 | 0.01 |
| 1.2 | 0.06 | 0.13 | 0.01 |
| 1.4 | 0.08 | 0.17 | 0.02 |
| 1.6 | 0.10 | 0.20 | 0.03 |
| 1.8 | 0.12 | 0.23 | 0.04 |
| 2.0 | 0.15 | 0.25 | 0.03 |
| 2.2 | 0.17 | 0.28 | 0.03 |
| 2.4 | 0.19 | 0.30 | 0.02 |
| 2.6 | 0.22 | 0.32 | 0.02 |
| 2.8 | 0.25 | 0.35 | 0.01 |
| 3.0 | 0.29 | 0.38 | 0.02 |
| 3.2 | 0.31 | 0.41 | 0.01 |
| 3.4 | 0.33 | 0.42 | 0.01 |
| 3.6 | 0.35 | 0.44 | 0.01 |
| 3.8 | 0.37 | 0.46 | 0.00 |
| 4.0 | 0.38 | 0.47 | 0.01 |

TABLE XXX

| Relative Log Exposure | Red Exposure RTR' | RRF' | GRF' |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.00 | 0.01 | 0.00 |
| 0.8 | 0.00 | 0.01 | 0.00 |
| 1.0 | 0.00 | 0.01 | 0.01 |
| 1.2 | 0.01 | 0.02 | 0.02 |
| 1.4 | 0.02 | 0.02 | 0.02 |
| 1.6 | 0.03 | 0.00 | 0.01 |
| 1.8 | 0.04 | 0.01 | 0.01 |
| 2.0 | 0.04 | 0.01 | 0.01 |
| 2.2 | 0.06 | 0.02 | 0.02 |
| 2.4 | 0.07 | 0.02 | 0.01 |
| 2.6 | 0.08 | 0.02 | 0.02 |
| 2.8 | 0.09 | 0.01 | 0.01 |
| 3.0 | 0.10 | 0.01 | 0.02 |
| 3.2 | 0.12 | 0.01 | 0.02 |
| 3.4 | 0.14 | 0.02 | 0.02 |
| 3.6 | 0.15 | 0.02 | 0.02 |
| 3.8 | 0.17 | 0.02 | 0.02 |
| 4.0 | 0.18 | 0.02 | 0.01 |

Inspection of Tables XXVIII through XXX indicates that the measured responses do not provide a direct measure of the individual recording layer unit images with the exception of GRF' as a measure of the blue recording layer unit image. The measured RTR' and RRF' responses are affected by imagewise development in other recording layer units due to the spectral neutrality of developed silver and the additivity of density. Mathematical manipulation of the measured responses was used to determine the individual images in the red, green, and blue recording layer units (R, G, and B, respectively) in terms of their corresponding transmission densities.

A plot of RTR' versus GRF' for the blue separation exposure was made. A best fit line satisfying the relationship $$\text{RTR}' = \text{a1} \times GRF'$$

was determined using standard methods of linear regression over the range of exposures where image formation occurred in the blue recording layer unit only. A value of 1.231 was found for a1. The response of the blue recording layer unit (B) was determined using the relationship $$B=a1\times BRF.$$

A plot of RRF′ versus GRF′ was made for the same exposure. A best fit line satisfying the relationship $$RRF=a2\times GRF$$

was determined using standard methods of linear regression over the range of exposures where image formation occurred in the blue recording layer unit only. A value of 1.654 was found for a2.

A plot of RTR′ versus RRF′ for the green separation exposure was made. A best fit line satisfying the relationship $$RTR'=a3\times RRF$$

was determined using standard methods of linear regression over the range of exposures where image formation occurred in the green recording layer unit only. A value of 0.527 was found for a3. The response of the green recording layer unit (G) was determined using the relationship $$G=a3\times[RRF-(a2\times GRF)].$$

The response of the red recording layer unit (R) was determined using the following relationship $$R=RTR'-B-G$$

taking advantage of the spectral neutrality of the developed silver image in the three recording layer units and the additivity of transmission densities.

The independent recording layer responses (R, G, and B) determined for the neutral, blue, green, and red exposures determined using the relationships previously described are listed in Tables XXXI through XXXIV, respectively.

TABLE XXXI

| Relative Log Exposure | Neutral Exposure R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.01 | 0.00 | 0.00 |
| 0.8 | 0.02 | 0.00 | 0.00 |
| 1.0 | 0.02 | 0.01 | 0.00 |
| 1.2 | 0.03 | 0.02 | 0.01 |
| 1.4 | 0.05 | 0.03 | 0.01 |
| 1.6 | 0.05 | 0.04 | 0.02 |
| 1.8 | 0.05 | 0.05 | 0.04 |
| 2.0 | 0.08 | 0.06 | 0.04 |
| 2.2 | 0.09 | 0.07 | 0.05 |
| 2.4 | 0.10 | 0.08 | 0.06 |
| 2.6 | 0.09 | 0.10 | 0.07 |
| 2.8 | 0.10 | 0.11 | 0.07 |
| 3.0 | 0.09 | 0.12 | 0.09 |
| 3.2 | 0.09 | 0.13 | 0.10 |
| 3.4 | 0.10 | 0.13 | 0.11 |
| 3.6 | 0.10 | 0.13 | 0.12 |
| 3.8 | 0.11 | 0.14 | 0.14 |
| 4.0 | 0.11 | 0.14 | 0.15 |

TABLE XXXII

| Relative Log Exposure | Blue Exposure R | G | B |
|---|---|---|---|
| 0.0 | 0.00 | 0.00 | 0.00 |
| 0.2 | −0.01 | 0.00 | 0.01 |
| 0.4 | 0.01 | 0.00 | 0.00 |
| 0.6 | 0.01 | 0.00 | 0.00 |
| 0.8 | 0.01 | 0.00 | 0.00 |
| 1.0 | 0.00 | 0.00 | 0.01 |
| 1.2 | 0.00 | −0.01 | 0.02 |
| 1.4 | 0.00 | −0.01 | 0.04 |
| 1.6 | 0.00 | −0.01 | 0.05 |
| 1.8 | −0.01 | −0.02 | 0.07 |
| 2.0 | −0.02 | 0.00 | 0.09 |
| 2.2 | −0.02 | 0.00 | 0.10 |
| 2.4 | −0.01 | 0.00 | 0.11 |
| 2.6 | −0.01 | 0.00 | 0.12 |
| 2.8 | 0.00 | 0.00 | 0.14 |
| 3.0 | 0.01 | 0.01 | 0.15 |
| 3.2 | 0.01 | 0.01 | 0.17 |
| 3.4 | 0.02 | 0.01 | 0.18 |
| 3.6 | 0.01 | 0.00 | 0.22 |
| 3.8 | 0.00 | −0.01 | 0.26 |
| 4.0 | −0.01 | −0.01 | 0.30 |

TABLE XXXIII

| Relative Log Exposure | Green Exposure R | G | B |
|---|---|---|---|
| 0.0 | 0.00 | 0.00 | 0.00 |
| 0.2 | −0.01 | 0.01 | 0.00 |
| 0.4 | −0.01 | 0.01 | 0.00 |
| 0.6 | −0.02 | 0.02 | 0.00 |
| 0.8 | 0.00 | 0.01 | 0.01 |
| 1.0 | −0.01 | 0.03 | 0.01 |
| 1.2 | −0.01 | 0.06 | 0.01 |
| 1.4 | −0.02 | 0.07 | 0.02 |
| 1.6 | −0.02 | 0.08 | 0.04 |
| 1.8 | −0.02 | 0.09 | 0.05 |
| 2.0 | 0.01 | 0.11 | 0.04 |
| 2.2 | 0.01 | 0.12 | 0.04 |
| 2.4 | 0.02 | 0.14 | 0.02 |
| 2.6 | 0.04 | 0.15 | 0.02 |
| 2.8 | 0.06 | 0.18 | 0.01 |
| 3.0 | 0.08 | 0.18 | 0.02 |
| 3.2 | 0.09 | 0.21 | 0.01 |
| 3.4 | 0.11 | 0.21 | 0.01 |
| 3.6 | 0.11 | 0.22 | 0.01 |
| 3.8 | 0.13 | 0.24 | 0.00 |
| 4.0 | 0.14 | 0.26 | −0.01 |

TABLE XXXIV

| Relative Log Exposure | Red Exposure R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | −0.01 | 0.01 | 0.00 |
| 0.8 | −0.01 | 0.01 | 0.00 |
| 1.0 | −0.01 | 0.00 | 0.01 |
| 1.2 | −0.01 | −0.01 | 0.02 |
| 1.4 | 0.00 | −0.01 | 0.02 |
| 1.6 | 0.03 | −0.01 | 0.01 |
| 1.8 | 0.03 | 0.00 | 0.01 |
| 2.0 | 0.03 | 0.00 | 0.01 |
| 2.2 | 0.04 | −0.01 | 0.02 |
| 2.4 | 0.06 | 0.00 | 0.01 |
| 2.6 | 0.06 | −0.01 | 0.02 |
| 2.8 | 0.08 | 0.00 | 0.01 |
| 3.0 | 0.09 | −0.01 | 0.02 |
| 3.2 | 0.11 | −0.01 | 0.02 |
| 3.4 | 0.12 | −0.01 | 0.02 |
| 3.6 | 0.13 | −0.01 | 0.02 |
| 3.8 | 0.15 | −0.01 | 0.02 |

TABLE XXXIV-continued

| Relative Log Exposure | Red Exposure R | G | B |
|---|---|---|---|
| 4.0 | 0.17 | 0.00 | 0.01 |

Photographic reproductions of recorded scenes can be produced in the same manner as previously described.

The invention has been described in detail with particular reference to certain preferred embodiments thereof, but it will be understood that variations and modifications can be effected within the spirit and scope of the invention.

What is claimed is:

1. A method of obtaining from an imagewise exposed photographic element separate records of the imagewise exposure to each of the blue, green and red portions of the spectrum comprising (a) photographically processing an imagewise exposed photographic element comprised of
a support and, coated on the support,
a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support and an intermediate emulsion layer unit located between the first and last emulsion layer units, and (b) obtaining separate blue, green and red exposure records from the photographic element,

WHEREIN (c) the photographic element is additionally comprised of
interposed between the first emulsion layer unit and the intermediate emulsion layer unit a first interlayer unit for transmitting to the first emulsion layer unit electromagnetic radiation this emulsion layer unit is intended to record and
interposed between the last emulsion layer unit and the intermediate emulsion layer unit a second interlayer unit for transmitting to the intermediate and first emulsion layer units electromagnetic radiation these emulsion layer units are intended to record,
one of the first and second interlayer units being capable of absorbing electromagnetic radiation within at least one wavelength region and emitting electromagnetic radiation within a longer wavelength region and the other of the first and second interlayer units being capable of reflecting or absorbing electromagnetic radiation within at least one wavelength region, (d) the imagewise exposed photographic element is photographically processed to produce a silver image in each of the emulsion layer units, (e) the photographic element is scanned utilizing electromagnetic radiation emitted from one of the first and second interlayer units to provide a first record of the image information in one of the first and last emulsion layer units and is scanned utilizing reflection or absorption of the remaining of the first and second interlayer units to provide a second record of the image information in one other of the emulsion layer units, (f) the photographic element is scanned through the first and second interlayer units and all of the emulsion layer units to provide a third record representing a combination of images in all of the emulsion layer units, and (g) separate blue, green and red exposure records are obtained from the first, second and third records.

2. A method according to claim 1 wherein the first record is created by scanning the last emulsion layer unit in a wavelength region in which the second interlayer unit is capable of absorbing and emitting light in a longer wavelength region and measuring the modulation of emitted light from the second interlayer unit by developed silver in the last emulsion layer unit.

3. A method according to claim 1 wherein the support is transparent following photographic processing and the second record is created by scanning the first emulsion layer unit through the support in a wavelength region in which the first interlayer unit is capable of absorbing and emitting light in a longer wavelength region and measuring the modulation of emitted light from the first interlayer unit by developed silver in the first emulsion layer unit.

4. A method according to claim 1 wherein the support is transparent following photographic processing and the third record is created by scanning through the first and second interlayer units, all of the emulsion layer units, and the support.

5. A method according to claim 1 wherein the support is reflective following photographic processing and the second record is created by scanning through the last emulsion layer unit, the second interlayer unit, and the intermediate emulsion layer unit in a wavelength region in which the first interlayer unit is capable of absorbing and emitting light in a longer wavelength region and measuring the modulation of emitted light from the first interlayer unit by developed silver in the intermediate and last emulsion layer units.

6. A method according to claim 1 wherein the support is reflective following photographic processing and the third record is created by scanning through the first and second interlayer units and all of the emulsion layer units and measuring the modulation of reflectance from the support by developed silver in all of the emulsion layer units.

7. A method of obtaining from an imagewise exposed photographic element separate records of the imagewise exposure to each of the blue, green and red portions of the spectrum comprising (a) photographically processing an imagewise exposed photographic element comprised of
a support that is transparent following photographic processing and, coated on the support,
a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support and an intermediate emulsion layer unit located between the first and last emulsion layer units, and (b) obtaining separate blue, green and red exposure records from the photographic element,

WHEREIN (c) the photographic element is additionally comprised of interposed between the first emulsion layer unit and the intermediate emulsion layer unit a first interlayer unit for transmitting to the first emulsion layer unit electromagnetic radiation this emulsion layer unit is intended to record and interposed between the last emulsion layer unit and the intermediate emulsion layer unit a second interlayer unit for transmitting to the intermediate and first emulsion layer units electromagnetic radiation these emulsion layer units are intended to record, each of the first and second interlayer units being capable of absorbing electromagnetic radiation within at least one wavelength region and emitting electromagnetic radiation within a longer wavelength region, (d) the imagewise exposed photographic element is photographically processed to produce a silver image in each of the emulsion layer units, (e) the photographic element is scanned utilizing electromagnetic radiation emitted from the second interlayer unit to provide a first record of the image information in the last emulsion layer unit, (f) the photographic element is scanned utilizing electromagnetic radiation emitted from the first interlayer unit to provide a second record of the image information in the first emulsion layer units, and (g) the photographic element is scanned through the first and second interlayer units, all of the emulsion layer units, and the support to provide a third record representing a combination of images in all of the emulsion layer unit, and (g) the first, second and third records are compared to obtain separate blue, green and red exposure records.

8. A method according to claim 7 wherein the first and second interlayer units absorb electromagnetic radiation in the same wavelength region and emit electromagnetic radiation in distinguishably different wavelength regions.

9. A method according to claim 7 wherein the first and second interlayer units absorb electromagnetic radiation in different wavelength regions.

10. A method according to claim 7 wherein the first and second interlayer units absorb electromagnetic radiation in the same wavelength region and emit electromagnetic radiation in the same longer wavelength region.

11. A method according to claim 8 wherein the first and second interlayer units are each optically isolated from the other so that scanning that excites emission from one of the interlayer units does not excite emission from the remaining of the interlayer units.

12. A method of obtaining from an imagewise exposed photographic element separate records of the imagewise exposure to each of the blue, green and red portions of the spectrum comprising (a) photographically processing an imagewise exposed photographic element comprised of a reflective support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support and an intermediate emulsion layer unit located between the first and last emulsion layer units, and (b) obtaining separate blue, green and red exposure records from the photographic element,

WHEREIN (c) the photographic element is additionally comprised of interposed between the first emulsion layer unit and the intermediate emulsion layer unit a first interlayer unit for transmitting to the first emulsion layer unit electromagnetic radiation this emulsion layer unit is intended to record and interposed between the last emulsion layer unit and the intermediate emulsion layer unit a second interlayer unit for transmitting to the intermediate and first emulsion layer units electromagnetic radiation these emulsion layer units are intended to record, each of the first and second interlayer units being capable of absorbing electromagnetic radiation within at least one wavelength region and emitting electromagnetic radiation within a longer wavelength region, the first and second interlayer units being chosen to provide distinguishable emissions, (d) the imagewise exposed photographic element is photographically processed to produce a silver image in each of the emulsion layer units, (e) the photographic element is scanned utilizing electromagnetic radiation emitted from the second interlayer unit to provide a first record of the image information in last emulsion layer unit, (f) the photographic element is scanned through the last emulsion layer unit, the second interlayer unit, and the intermediate interlayer unit to excite emission from the first interlayer unit and to provide a second record of the image information in the intermediate and last emulsion layer units, (g) the photographic element is scanned through the first and second interlayer units and all of the emulsion layer units to obtain a reflectance from the support modulated by developed silver in all of the emulsion layer units and thereby provide a third record representing a combination of images in all of the emulsion layer units, and (g) the first, second and third records are compared to obtain separate blue, green and red exposure records.

13. A method according to claim 12 wherein one of the first and second interlayer units emits over a longer time interval following excitation than the remaining of the interlayer units.

14. A method according to claim 12 wherein the first and second interlayer units absorb electromagnetic radiation within the same wavelength region and emit in different longer wavelength regions.

15. A method according to claim 12 wherein the first and second interlayer units absorb electromagnetic radiation within different wavelength regions.

* * * * *